US006007074A

United States Patent [19]

Tarng

[11] Patent Number: 6,007,074

[45] Date of Patent: Dec. 28, 1999

[54] FRICTIONLESS NONCONTACT ENGAGING DRIVE SKATE AND SKATEBOARD

[75] Inventor: Min Ming Tarng, San Jose, Calif.

[73] Assignee: Tang System, San Jose, Calif.

[21] Appl. No.: 08/110,629

[22] Filed: Aug. 23, 1993

Related U.S. Application Data

[63] Continuation-in-part of application No. 07/662,717, Mar. 1, 1991, abandoned, which is a continuation of application No. 07/389,691, Aug. 3, 1989, abandoned.

[51] Int. Cl.[6] ..... B62M 1/04

[52] U.S. Cl. ..... 280/11.115; 280/844; 280/87.042; 305/44; 192/84.3

[58] Field of Search ..... 280/11.28, 11.115, 280/844, 11.21, 87.041, 87.042; 192/84.3; 305/44

[56] References Cited

U.S. PATENT DOCUMENTS

| | | | |
|---|---|---|---|
| 1,604,923 | 10/1926 | Laurier . | |
| 2,246,191 | 6/1941 | Schmitz | 280/64 |
| 4,143,747 | 3/1979 | Langieri, Jr. | 192/64 |
| 4,181,319 | 1/1980 | Hirbod | 280/11.115 |
| 4,411,442 | 10/1983 | Rills | 280/11.115 |
| 5,382,052 | 1/1995 | Tarng | 280/844 |

*Primary Examiner*—David M. Mitchell

[57] ABSTRACT

The single-foot drivable skate and skateboard is constituted of the simultaneously steering-driving mechanism, synchronous differential driving mechanism, wheel and board. The simultaneously steering-driving mechanism comprises a universal pedal, the driving-steering rod and the single pole truck. The single pole truck pivotally supports the board with a pivot joint or ball joint. The driving-steering rod slides in the slot passing through the pivotal joint and the truck. The synchronous differential driving mechanism made of the noncontact gripping force or the upper-bounded gripping force includes the engaging drums shifted by the shift screws. The shift screws are knotched at the ends of the crankshaft axis. With the manipulation of a sole or heel, the skate or skateboard can twist the pedal to skate, tread the pedals to skate forward and backward, accelerate, decelerate, free-run, brake, turn right and left. To run on muddy and snowy roads, the non-stretchable length-adjustable belts are wrapped on the groovy sprocket wheels. The universal length-adjusting gears adjust the length of the belts and keep the tension in the belts.

20 Claims, 21 Drawing Sheets

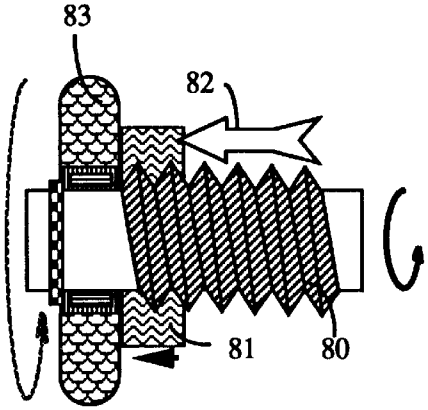
FIG. 17
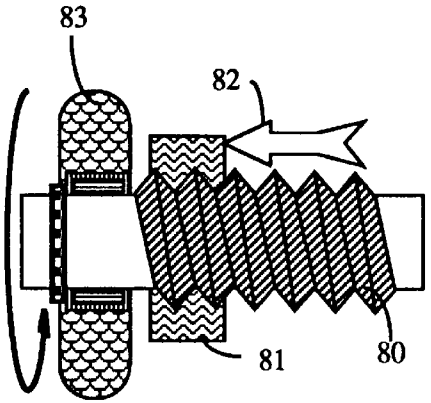
FIG. 18
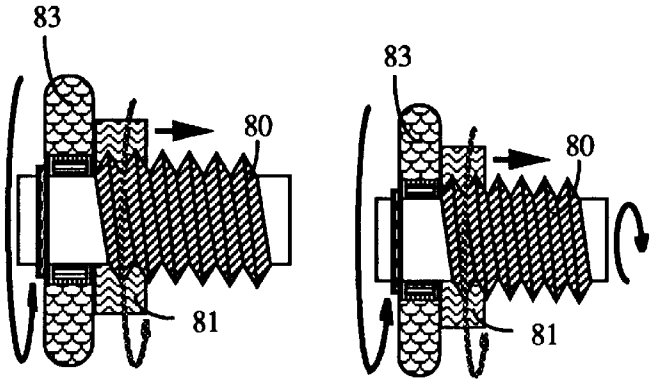
FIG.19A
FIG.19B
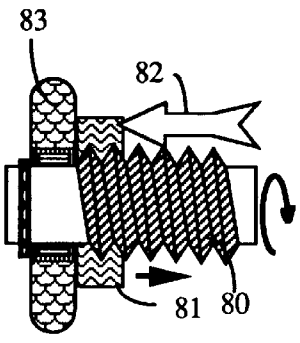
FIG.19C

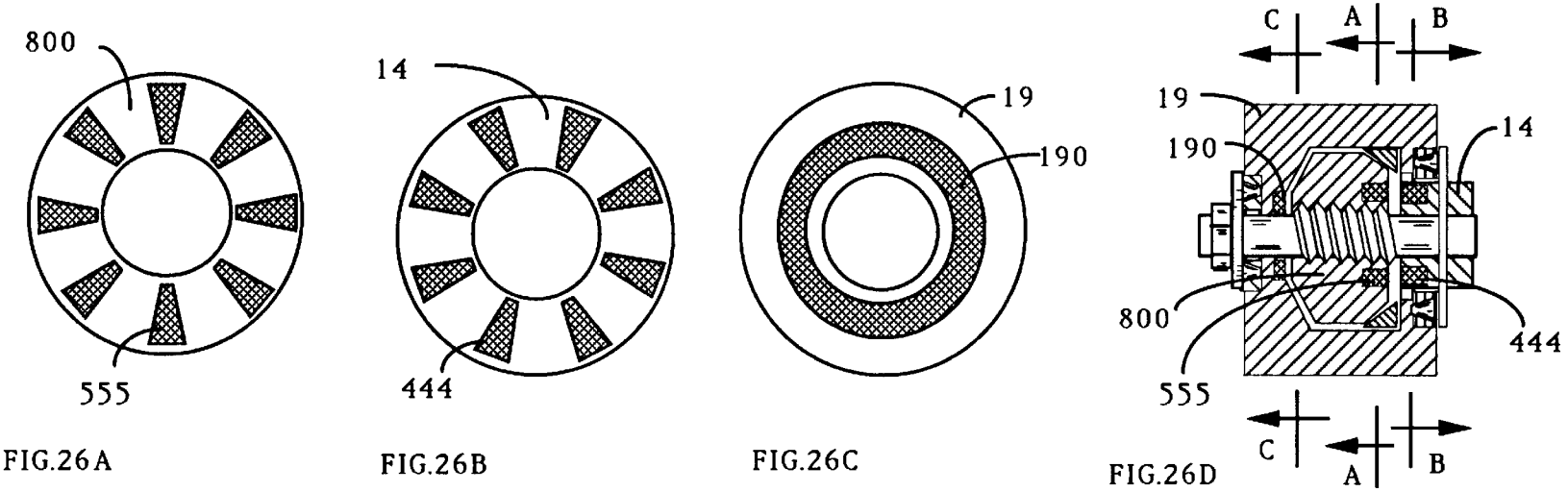
14
444
B
A
C
19
190
800
555
FIG.26D
19
190
FIG.26C
14
444
FIG.26B
800
555
FIG.26A
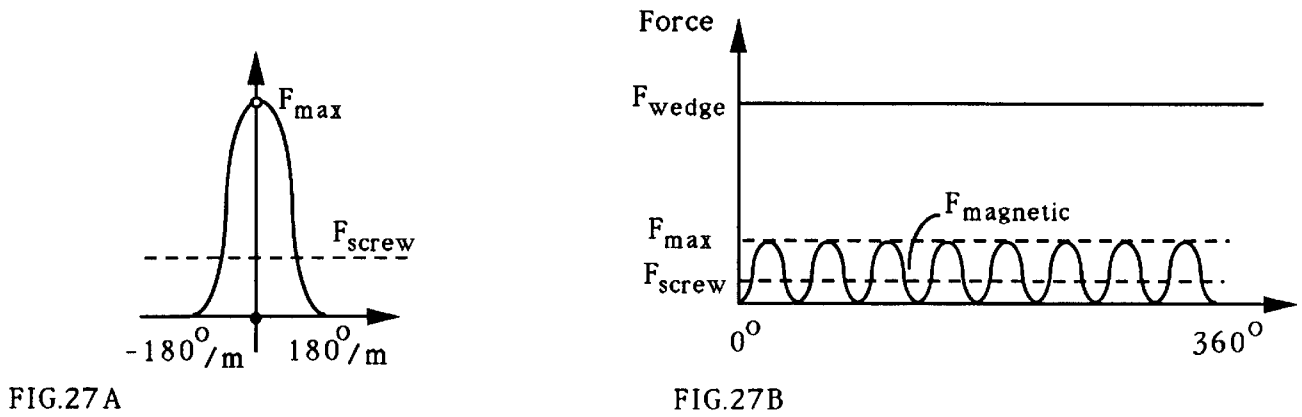
Force
$F_{wedge}$
$F_{max}$
$F_{screw}$
$F_{magnetic}$
$0^o$
$360^o$
FIG.27B
$F_{max}$
$F_{screw}$
$-180^o/m$
$180^o/m$
FIG.27A

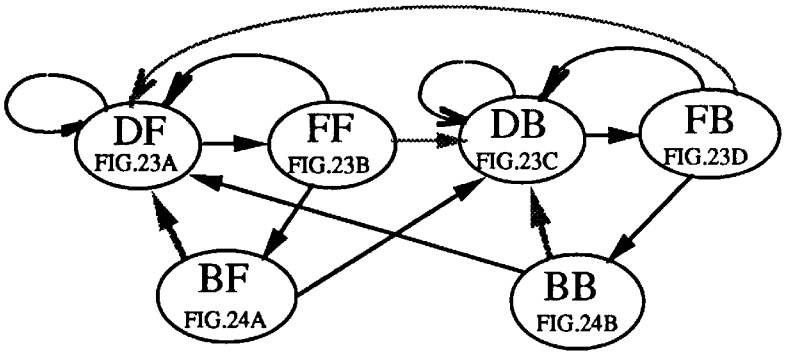
FIG. 28
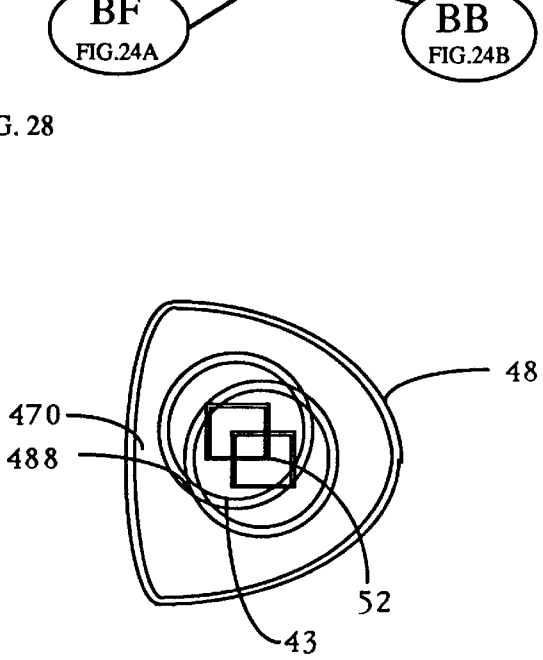
FIG. 29C
FIG. 29A
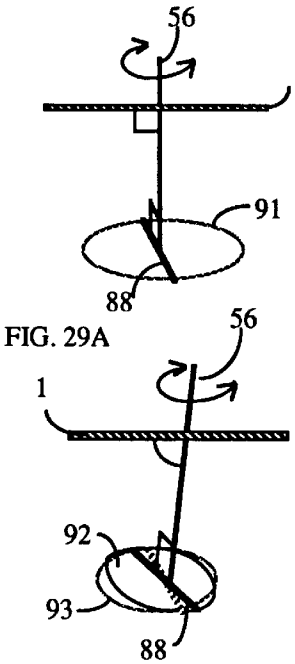
FIG. 29B
FIG. 30A
FIG. 30B
FIG. 30C

FRICTIONLESS NONCONTACT ENGAGING DRIVE SKATE AND SKATEBOARD

This is a continuation-in-part of Ser. No. 07/662,717, filed Mar. 1, 1991 and now abandoned, which is a continuation of Ser. No. 07/389,691 filed Aug. 3, 1989.

BACKGROUND

1. Field of Invention

This invention relates to a frictionless and noisefree differential drive. With a noncontact engaging mechanism, the rider has on board driving and steering capability.

2. Description of Prior Art

So far, none of the foot-powered vehicles have multiple functions of steering, braking, driving forward, driving backward and free-running. This causes limitations in every aspect. For example, the skater needs to push against the ground and the dancer cannot slide across the stage with a pose. The sets strict restrictions in the performance.

The skateboard is a popular short-range transportation apparatus. The inventor has created several types of skateboards having foot-powered capability. The rider does not need to push against the ground. However, none of the skateboards have onboard single-foot driving, steering, braking, differential drive, twisting to skate and noiseless free-running capabilities. U.S. Pat. No. 4,411,442 issued to Rills (1983) discloses a curved toothed rachet gear rack which engages the curved pinion gear to impart rotational energy to the wheels. His ratchet gear rack is easily broken when the rider hits the stone in jumping. His ratchet mechanism drives forward only. His ratchet gear racks arc too noisy in driving. His curved pinion gears are too expensive to manufacture. Even in the free running mode, the ratchet mechanism makes a lot of noise and makes the rider uncomfortable to ride. The ratchet mechanism does not have the brake and driving backward functions. His invention uses the tilt of the board to change the direction. It makes the board unstable to stand on. His pedal doesn't have the combinatory functions of braking, driving and steering. U.S. Pat. No. 4,861,054 issued to Spital (1989) shows a pedal-powered skateboard which is too heavy for the rider to carry. Similar to the automobile transmission, his invention adopts many gears which are too expensive for a skateboard. His invention adopts the overrunning clutch which drives forward only. The crank mechanism uses reversible stroke motion. As the crank mechanism moves upward, it cannot drive the ratchet gear. Half of the working cycle is wasted. His invention has no brake. To steer his skateboard, the rider tilts the deck which is high above the ground. It is very dangerous to ride his skateboard. U.S. Pat. No. 3,399,906 issued to Portnoff (1968) showed a skateboard using the curved gear rack. It is too noisy to use. The skateboard has no steering capability and braking capability. U.S. Pat. No. 1,574,517 issued to Rohdiek (1926) showed a propelling mechanism having ratchet teeth or gear with a roller clutch. The ratchet teeth are too noisy. For a skateboard, the gear equipped with roller clutch mechanism is too large to be used. The board swivels such that the rider has difficulty standing on the board. His invention has no brake capability. The rider uses two hands to steer the vehicle. U.S. Pat. No. 4,181,319 issued to Hirbod (1980) shows a ski equipped with the crank mechanism but having no ratchet mechanism. His rubber gasket is to prevent the undesirable cross-movement. His rubber gasket doesn't have the multiple functions of my invention: the shock absorber, steering and recovering the wheels to straight forward position. His invention doesn't have the free-running capability. The rider stands on the pads with two feet continuously stepping on the pads upward and downward. There is no time for the rider to rest. The pedal doesn't have the steering capability. The rider cannot use the pedal to brake.

Furthermore, standing on the pedals and twisting the pedal, my skateboard can skate backward and forward. None of the prior art has the twisting capability to skate forward and backward.

The differential drive for a single continuous undivided drive axle is very important fundamental technology. U.S. Pat. No. 836,035 issued to Hendricks (1906) showed a continuous undivided axle with clutch mechanism thereby elinimating the expensive and intricate gearing and trusses employed with divided axles. The frictionless and noisefree differential drive has been the bottleneck of the skateboard technology. U.S. Pat. No. 2,246,191 issued to Schmitz (1941) shows a velocipede driving mechanism for a single wheel only, not for differential drive. My invention has the differential drive having engaging drive mechanism. The engaging mechanism replaces the ratchet and/or the gear mechanism used in the skateboard.

Furthermore, the U.S. Pat. No. 2,246,191 issued to Schmitz uses spring clip finger 20 in FIG. 2 to secure the two collar parts with the radial friction force. As stated in the U.S. Pat. No. 4,143,747 issued to Langieri, Jr., the spring clip finger is easily broken. So the coaster brake of Langieri, Jr. uses the eccentrically weighted driver of drum. However, the eccentrically wighted drum didn't solve the problem either. It caused the unbalance of the wheel and the safety problems of sudden lock of the wheel in high speed.

The key issue in the engaging mechanism is how to hold the engaging drum without friction and the failure of the mechanical parts.

To solve the above problems of the frictionless and noisefree grip of the engaging mechanism, my invention makes a lot of technological breakthroughs. In the first version, I change the radial frictional force to be the upper bounded axlewise gripping force. The engaging mechanism is filled with the grease. Therefore, there is less friction between the mechanical parts of the engaging mechanism. Furthermore, the gripper protects the spring from the moving part of the engaging mechanism so that the spring will not be broken. As the driving force exceeds the upper bounded axlewise force set by the spring, the gripper automatically releases the engaging drum. With the upper-bounded axlewise force, the engaging mechanism can work at high speed without the failure of the engaging mechanism.

In the second version, I make the fundamental breakthrough of the noncontact force. The contact mechanical force is replaced with the noncontact magnetic or electrical gripping force. The working principle of the noncontact gripping force is completely different from those of the mechanical frictional force. The noncontact engaging mechanism uses the minimum potential energy to hold the engaging drum and uses the rider's momentum to smooth the riding.

To run on a muddy or snowy road, the skateboard needs on-board manipulatory capibilities. The on-board manipulation includes on-board driving, on-board steering and on-board braking capabilities. U.S. Pat. No. 4,337,961 issued to Covert et al. (1982) disclosed an invention using eight wheels and four belts. His invention has no on-board manipulatory capability. His belt is not designed for the foot-powered skateboard and cannot be used on the foot-powered skateboard. U.S. Pat. No. 1,604,923 issued to Laurier (1926) shows auto tract device with the spring or rubber band enveloping the rollers. The spring or rubber band have to be deformed in steering. So the stretchable belt does't have the capacity to carry the heavy load. Even worse, the restoring force in spring or rubber makes the steering very difficult. These problems make his stretchable track impractical. U.S. Pat. No. 3,934,664 issued to Pohjola (1976) shows the endless track. The central portion of the endless track is nonstretchable. The central region cannot adjust its length and the track cannot envelop wheels having varying wheel pitch. Furthermore, his track blocks the passage of the transmission line. The rotation power cannot be transmitted from feet to wheels. So the skateboard has no foot-powered driving capability. Even worse, during steering, the track slides on the roller. The friction between the roller and the track is a serious problem.

In summary of the previous patents, none of them has the novel design of a crank mechanism with a silent ratchet mechanism having steering capability. A ratchet mechanism makes noise. Half of the energy and working cycle are wasted.

The foot-powered skateboard adopting the ratchet mechanism has no brake capability, no backward drive capability and/or no steering capability. The skateboard using the crank mechanism has no ratchet mechanism. The rider has no time to rest. The rider cannot use the pedal to steer. All the foot-powered skateboards heretofore known suffer from a number of disadvantages:

(a) The pedal doesn't have single-foot manipulatory capabilities of steering, driving and braking. During driving, the rider must use hands or feet to activate the other mechanisms to steer or to brake the skateboard. It is inconvenient and dangerous.

(b) The skateboard doesn't have the backward driving capability, sideways driving capability, twisting to skate and brake capabilities.

(c) The ratchet mechanism can drive the wheels to run forward only. The ratchet mechanism makes too much noise. The energy in half the working cycle is wasted.

(d) It is dangerous to tilt the board in skating.

(e) The ratchet mechanism is too complex to manufacture. The ratchet mechanism is dangerous to operate. The exposed gear rack is a threat to the safety of children. The ratchet mechanism is too large to port.

(f) The gear is too heavy and it costs too much for a skateboard.

OBJECTS AND ADVANTAGES

This invention provides a skate apparatus with on-board driving, braking and steering capabilities. The pedals drive the crankshafts and wheels to rotate. The square pedal rod passes through the truck. As the rider turns the pedal, the truck and wheels change direction. Twisting the pedals recursively, the skateboard skates backward and forward. The engaging mechanism enables the skate apparatus to brake, free run, drive forward and backward. A groovy sprocket wheel, flexible belts and belt length adjusting mechanism enable the skate apparatus to drive on the ice, snow and muddy road. Slippers hold the skateboard to the rider's feet as the rider jumps up and down.

Besides the objects and advantages of the skate apparatus described as above, several other objects and advantages of the present invention are:

(a) to provide a pair of skating shoe to the dancer that the dancer can sweep across the stage with poses.

(b) to provide a short range transportation facility;

(c) to provide a new apparatus for social dance activities.

(d) to provide an apparatus for a new kind of atheletics.

Still further objects and advantages will become apparent from a consideration of the ensuing description and drawings.

DRAWING FIGURES

FIG. 1 (A) is the cross section view of skateboard with a pivotal joint taken at the I—I line in FIG. 1C; (B) is the side view of the skateboard having the sprocket wheel; (C) is the top view of the skateboard; (D) shows the alternative design and the operation of the self-propagating skateboard; (E) shows the twisting operation of the skateboard; (F) shows the skateboard having the snow tire and snow chain; it is equipped with the sprocket wheels and the length-adjusting mechanism for flexible belts.

FIG. 2 (A) is the cross section view of skate taken at the II—II line in FIG. 2B; this skate is equipped with a ball joint; (B) is the top view of the skate taken at the cut line X—X in FIG. 2A. In the drawings, the dancing skate has the similar structure as the skateboard in FIG. 1. (C) is the alternative design of the self-propagating skate; (D) is the top view of the steering mechanism adopted in FIG. 2C; (E) is the side view of the steering mechanism adopted in FIG. 2C.

FIG. 3 (A) is the enlarged cross section view of the skateboard wheel assembly taken at the III—III line in FIG. 3B; this skateboard is equipped with a ball joint; (B) is the partially exposed view of the skateboard wheel assembly for the engaging mechanism with the upper bounded axlewise gripping force; (C) is the partially exposed view of the skateboard wheel assembly with the noncontact engaging mechanism.

FIG. 4 (A) is the cross section view of the skateboard wheel assembly taken at the IV—IV line in FIG. 4B; this skateboard is equipped with a ball joint; (B) is the partially exposed view of the skateboard wheel assembly having the engaging mechanism; (C) is the partially exposed view of the wheel assembly having the noncontact engaging mechanism.

FIG. 5 (A) is the partially exposed section view of the ball joint and the square pedal rod taken at the V—V line in FIG. 3A; (B) is the partially exposed section view of the pivotal joint and the square pedal rod taken at the VI—VI line in FIG. 4A; (C) is the partially exposed section view of the ball joint and the square pedal rod taken at the VII—VII line in FIG. 1D; it shows the resilient bushing having the multiple functions of steering, recovering and anti-shock; (D) shows the side view of the steering joint taken at the D—D line in FIG. 5C; (E) shows the side view of the steering joint taken at the E—E line in FIG. 5C.

FIG. 17 shows the engaging operation of the engaging mechanism. As the right-handed screw rotates counter-clockwise, the engaging drum shifts left to engage with the left-half wheel on the left side of the engaging drum and drives the left-half wheel to rotate counter-clockwise.

FIG. 18 shows the engaging drum disengaging with the left-half wheel. As the left-half wheel rotates counter-clockwise or the screw rotates clockwise, as shown in FIG. 19, the engaging drum shifts right and disengages with the left-half wheel.

FIG. 19 (A) the left-half wheel rotates to have the engaging drum to disengage with the left-half wheel; (B) the left-half wheel and screw rotate to have the engaging drum disengage with the left-half wheel; (C) the screw rotates to have the engaging drum disengage with the left-half wheel.

Figure 20:
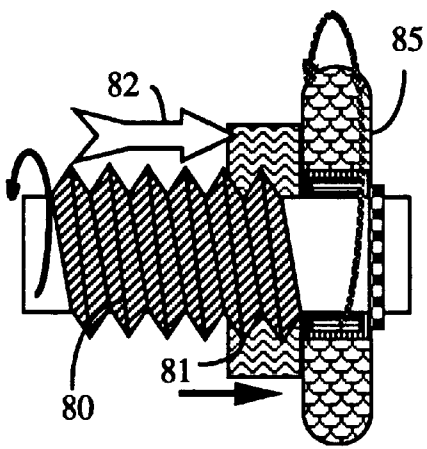

FIG. 20 shows the engaging operation of the driving mechanism: the right-handed screw rotates clockwise, the engaging drum shifts right to engage with the right-half wheel on the right half side of the engaging drum and drives the right-half wheel to rotate clockwise.

Figure 21:
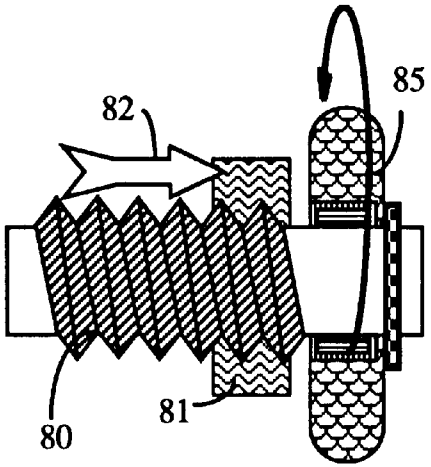

FIG. 21 shows nut disengaging with the right-half wheel; the right-half wheel is free to rotate. As the right-half wheel rotates clockwise or the screw rotates counter-clockwise, as shown in FIG. 22, the engaging drum shifts left and disengages with the right-half wheel.

FIG. 22 (A) the right-half wheel rotates to have the engaging drum disengage with the right-half wheel; (B) the right-half wheel and screw rotate to have the nut disengage with the right-half wheel; (C) the screw rotates to have the nut disengage with the right-half wheel; the engaging drum is gripped by the gripping force.

FIG. 23 is the combinatory wheel of the left-half wheel in FIG. 17 and the right-half wheel in FIG. 20 to have the wheel as shown in FIG. 3 and FIG. 4; (A) the crank rotates to engage with the wheel on the left side and drives the wheel to rotate counter-clockwise; (B) the wheel rotates counter-clockwise to disengage with the wheel; (C) the crank rotates clockwise to engage with the wheel on the right side to rotate clockwise; (D) the wheel rotates clockwise to disengage with the wheel.

FIG. 24 shows the wheel being locked in the brake mode: (A) the crank rotates clockwise to lock the wheel which rotates counter-clockwise; (B) the crank rotates counter-clockwise to lock the wheel which rotates clockwise.

Figure 25:
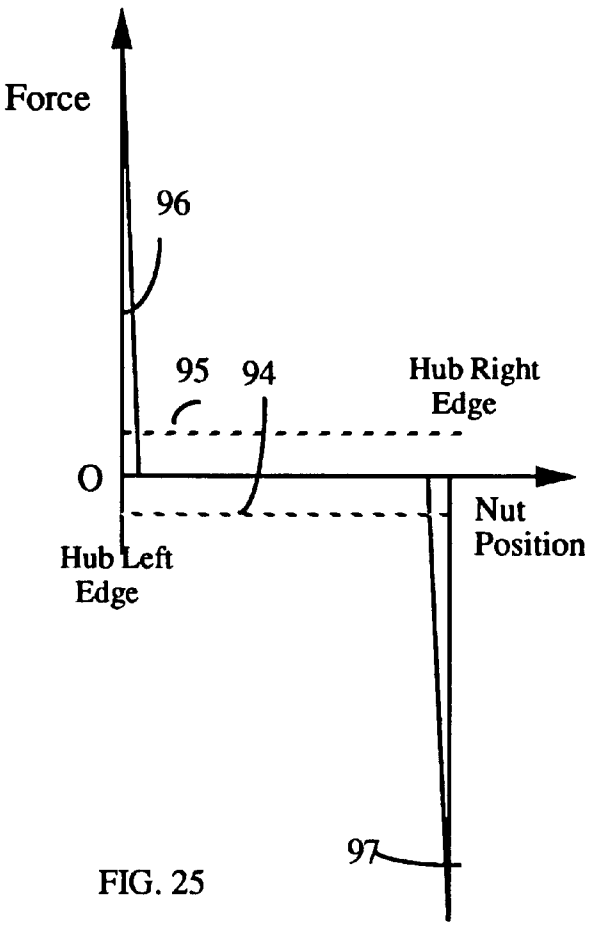

FIG. 25 shows the fundamental principle of the engaging mechanism.

FIG. 26 shows the alignment of the poles of noncontact force; (A) is the section view taken along the A—A line in FIG. 26D; it shows the poles of noncontact force being embedded in the engaging drum; (B) is the section view taken along the B—B line in FIG. 26D; it shows the poles of noncontact force being embedded in the truck; (C) is the section view taken along the C—C line in FIG. 26D; it shows the ring of the poles embedded in the hub; (D) is the section view of the noncontact force engaging mechanism.

FIG. 27 (A) is the noncontact gripping force as the function of angular displacement; (B) is the fundamental principle of the engaging mechanism made of the poles of noncontact force.

FIG. 28 is the state diagram to illustrate the operational transitions of engaging drive mechanism.

FIG. 29 (A) is the steering mechanism of the frame having the vertical axis; (B) is the steering mechanism of frame having the inclined axis; (C) is the deformation of the resilient bushing during steering.

FIG. 30 (A) is the top view of the belt chain; (B) is the cross-section taken along the IX—IX line in FIG. 30A; (C) is the cross section of the belt chain taken along XI—XI line in FIG. 30C.

DESCRIPTION

In the figures, a skate and a skateboard with various schemes are constructed in accordance with the present invention. FIG. 1 is the single-foot manipulatable skateboard; FIG. 2 is the skate having the minature of skateboard.

Figure 1C:
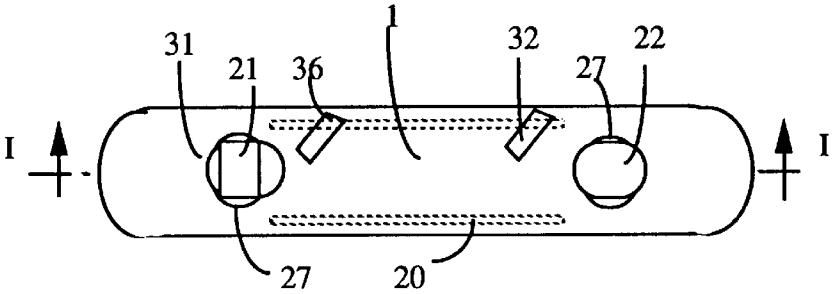
Figure 1A:
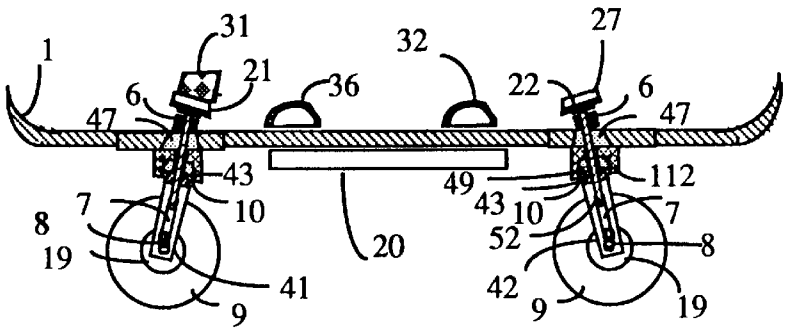
Figure 1B:
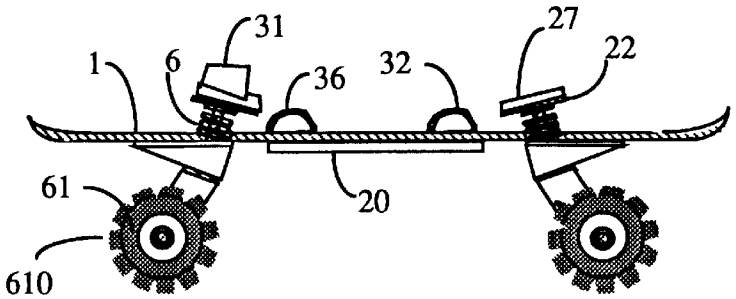
Figure 1D:
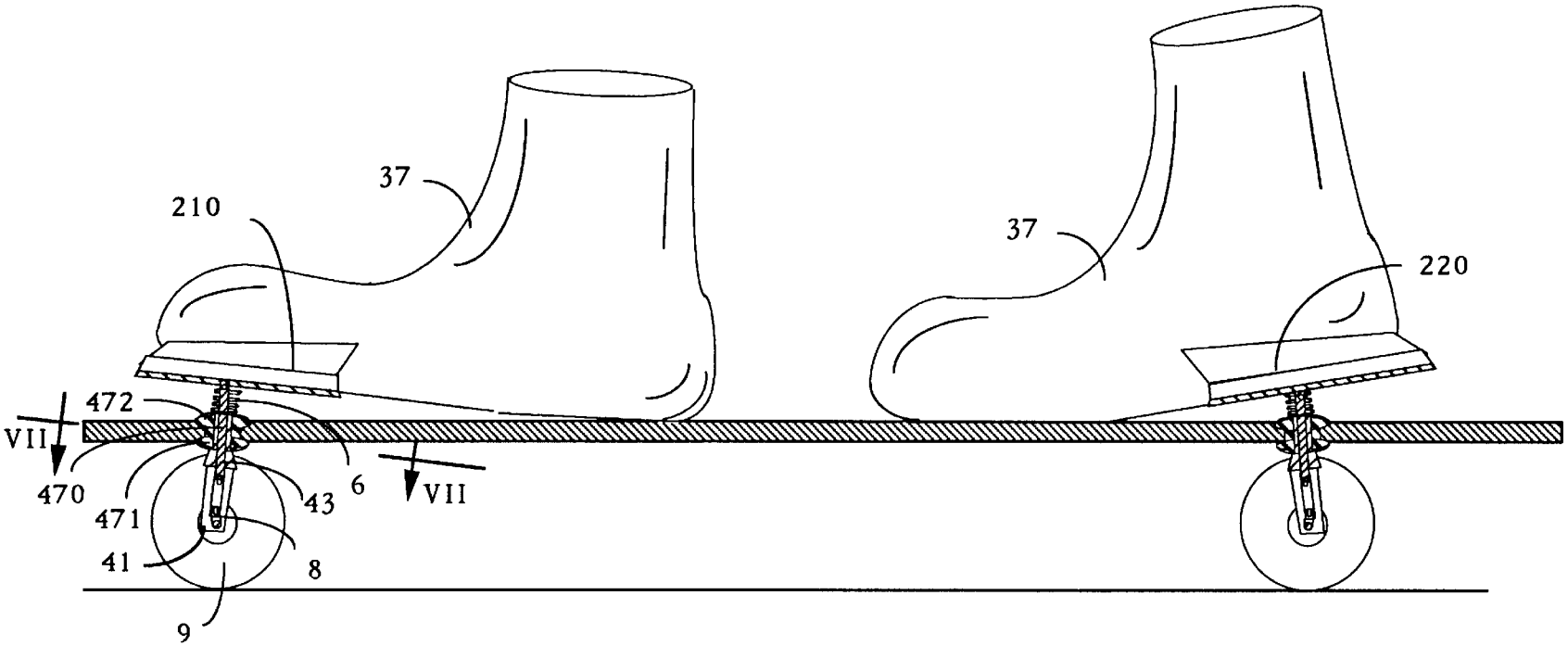
Figure 1E:
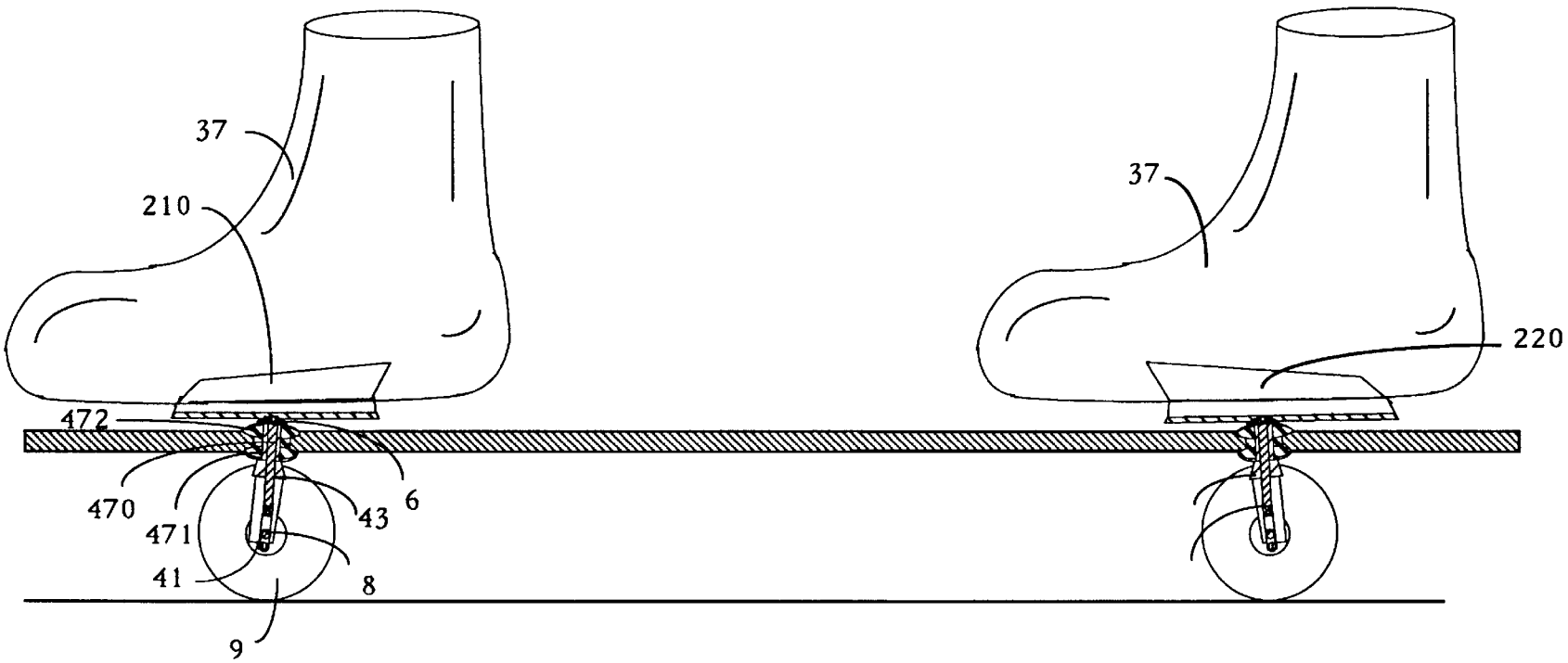
Figure 1F:
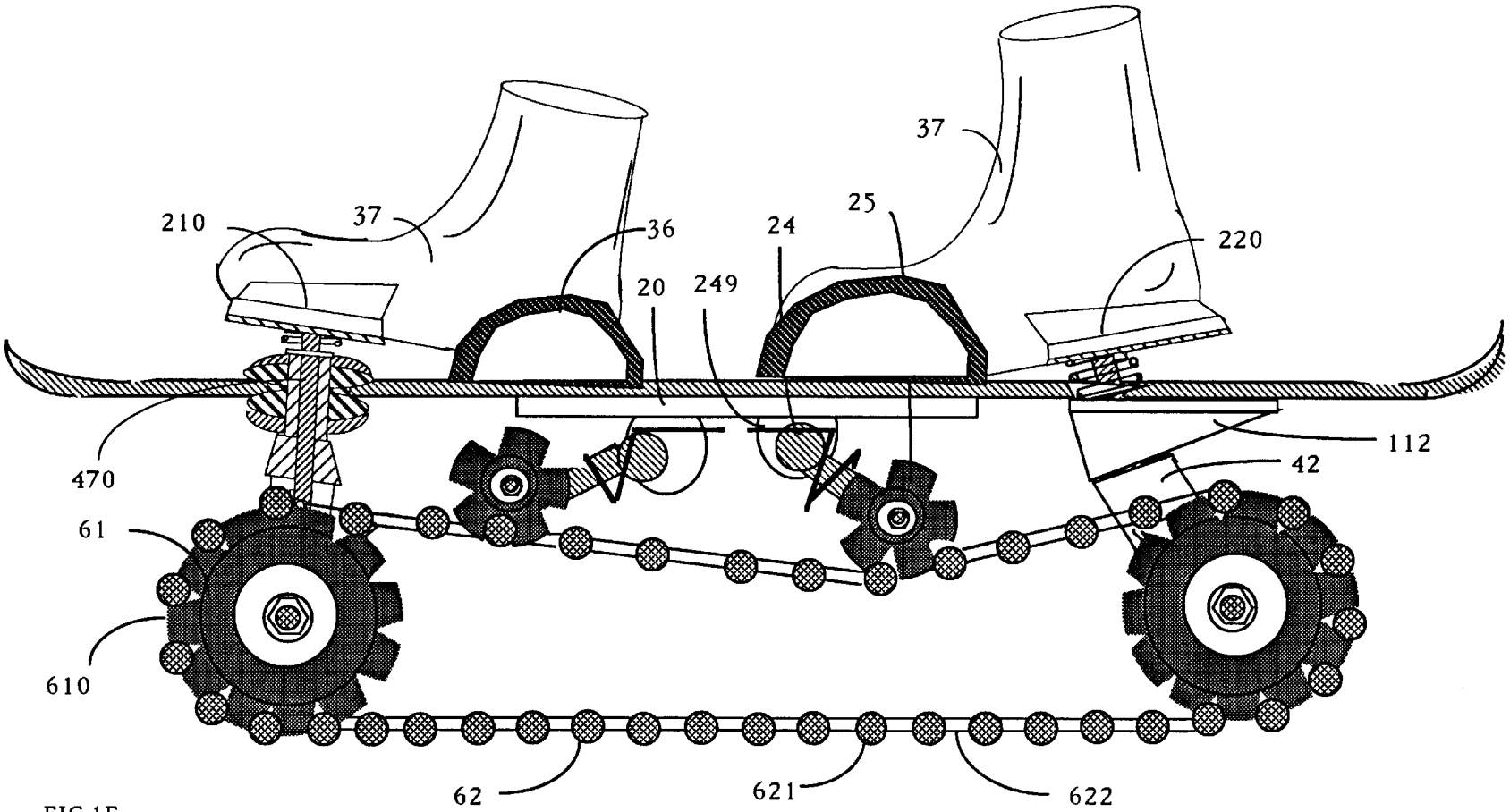
Figure 2C:
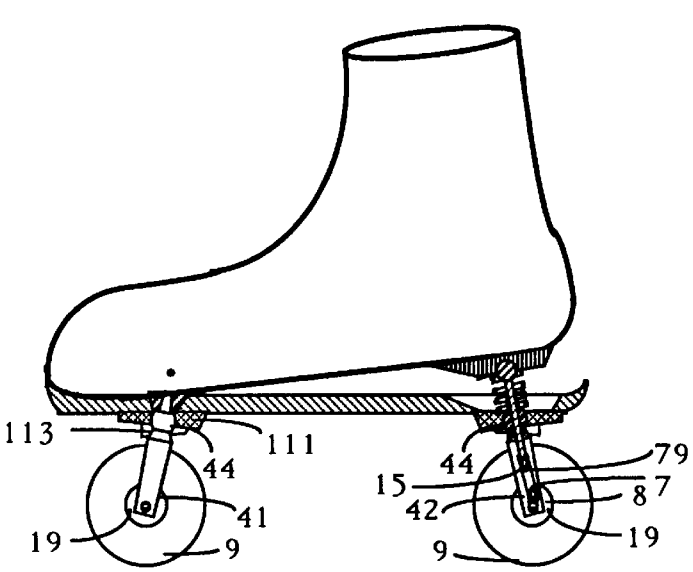
Figure 2E:
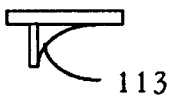
Figure 2D:
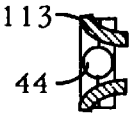
Figure 2A:
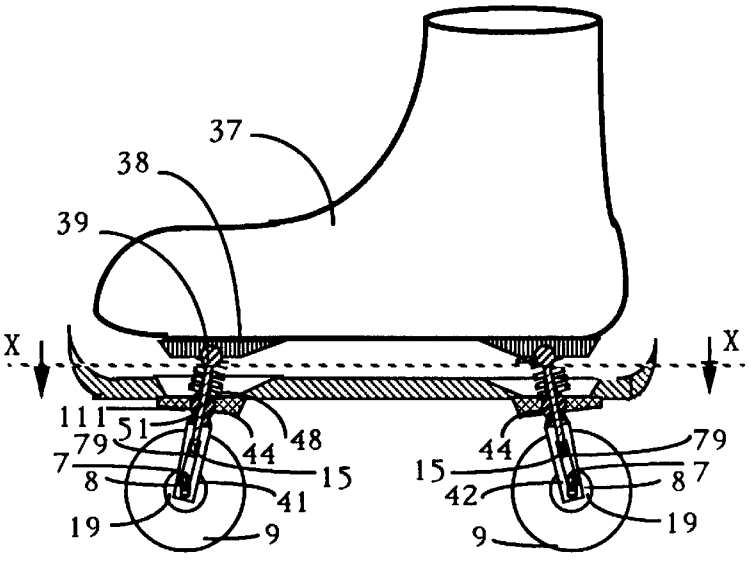
Figure 2B:
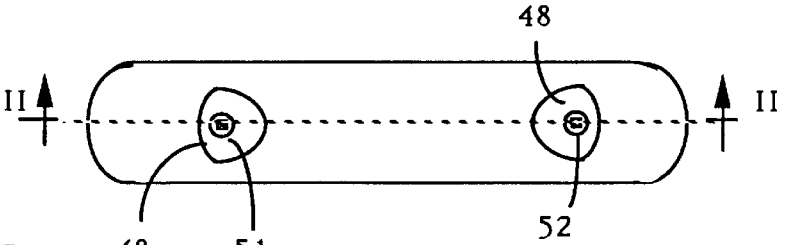

FIG. 1A is the cross section view taken at the line I—I as shown in FIG. 1C. FIG. 1C is the top view of the skateboard. In FIG. 1D, the rider stands on the board 1 and steps on the pedals alternatively to skate forward and backward. In FIG. 1E, the rider stands on the pedals twisting the pedals to skate forward and backward. The rims 27 of the pedals 21 and 22 hold the shoes during steering. The skateboard comprises an elongated board 1, a pair of pedals 21 and 22, slipper belts 32 and 36, a pair of rods 51 and 52, a pair of trucks 41 and 42, wheels 9, pivotal joints 43 or ball joints 44, crankshafts 8 and the protection strips 20. The front portion of the left foot treads on the front pedal 21. The heel of the right foot treads on the rear pedal 22. Standing on the board, the rider swings the body weight forward and backward. Accordingly, the left foot treads on the front pedal 21 and the right heel treads on the rear pedal 22 alternatively. The front pedal rod 51 and rear pedal rod 52 move downward and upward alternatively.

The left foot inserts in the slipper belt 31. The front portion of right foot inserts in the rear slipper belt 32. As the rider jumps, the skateboard is carried in the air by the feet of the rider.

FIG. 1D also shows the minor modifications of the skateboard. The front foot steps on the front pedal 210; the rear heel steps on the rear pedal 220. Stepping on the front pedal 210 and rear pedal 220 alternatively, the skateboard will skate forward and backward. The bottom rigid plate 471 and the top rigid plate 472 are an integrated unit. The plates 471 and 472 clamp the resilient bushing 470. FIG. 1E shows the twisting operation of the skateboard. The rider stands on the pedals and twists the pedals, the skateboard may skate forward and backward.

FIG. 2 is a skate which is a minature of the skateboard. FIG. 2A is the skate with the ball joint 44. The shoe 37 has a pad 38. The pad may fit inside the hole 48. The universal ball joint 39 seats inside the pad 38. FIG. 2B is the top view taken at the line X—X in FIG. 2A. FIG. 2C is the skate having the front portion of the skate attached to the shoe. The rider can use the heel to drive the skate. Tilting the skate, the steering bar 113 can force the trucks 41 and 42 to rotate and change the direction.

Figure 3A:
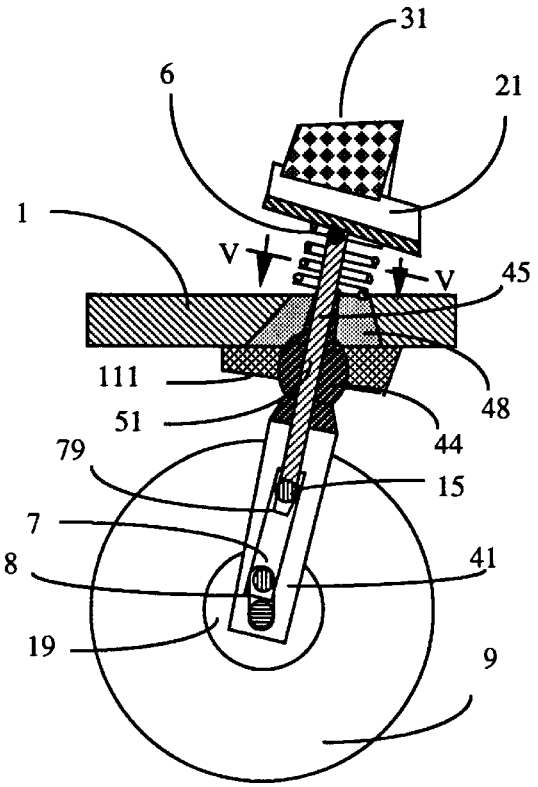
Figure 3B:
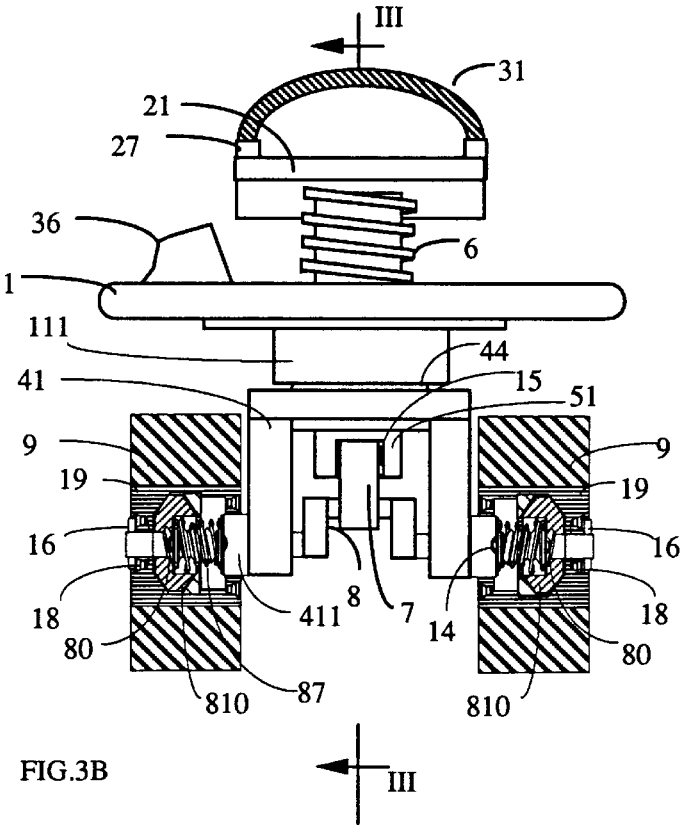
Figure 3C:
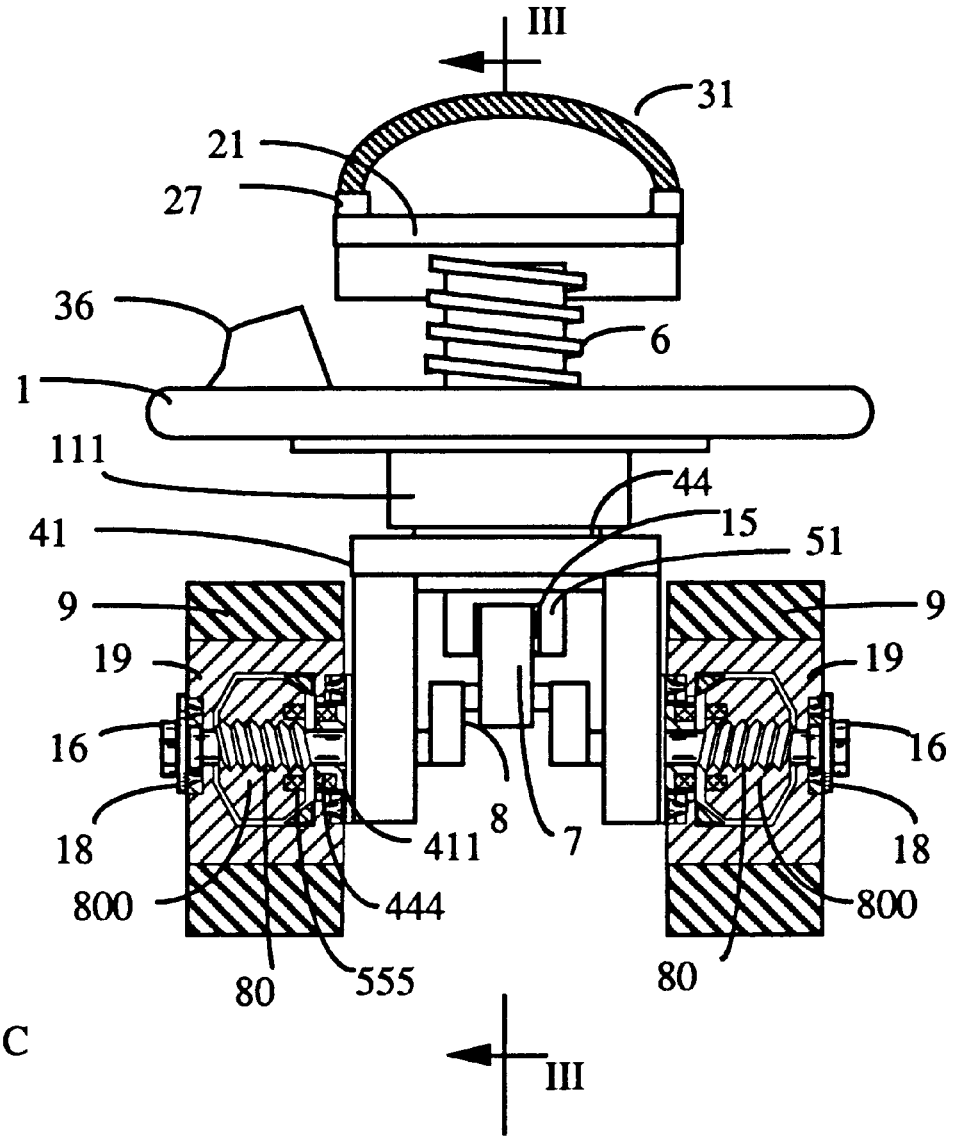

FIG. 3A is the partially exposed section view of the wheel assembly with the ball joint; FIG. 3B is the partially exposed cross section of the engaging mechanism having upper-bounded gripping force embedded in wheel assembly. FIG. 3C is the partially exposed cross section of the engaging mechanism having the noncontact force embedded in wheel assembly.

Figure 4A:
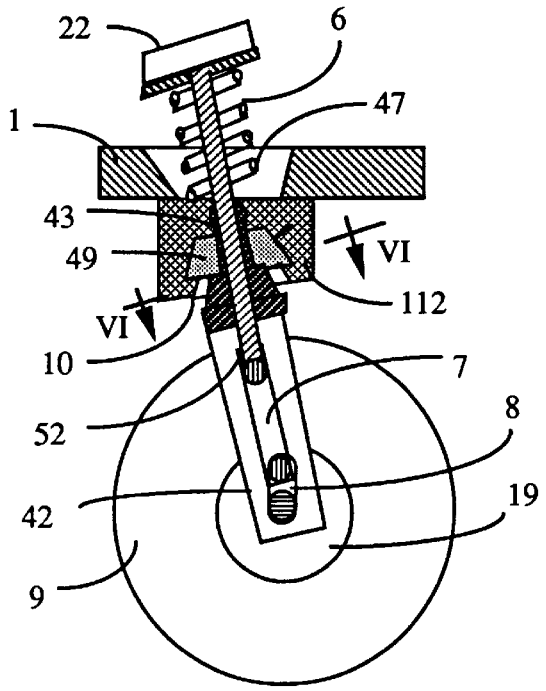
Figure 4B:
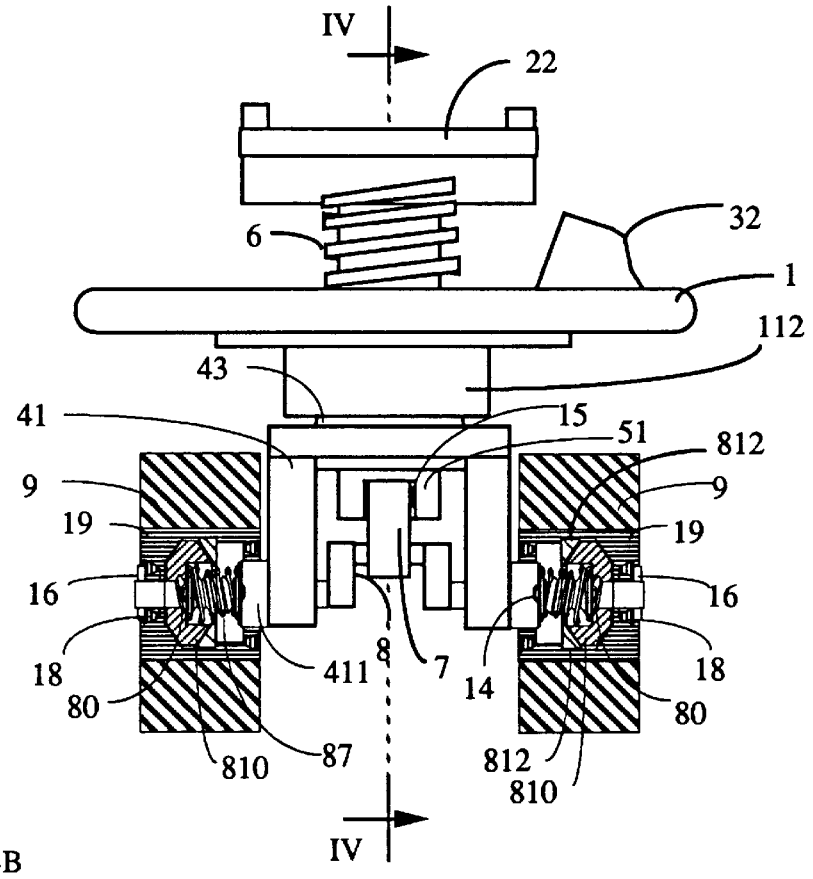
Figure 4C:
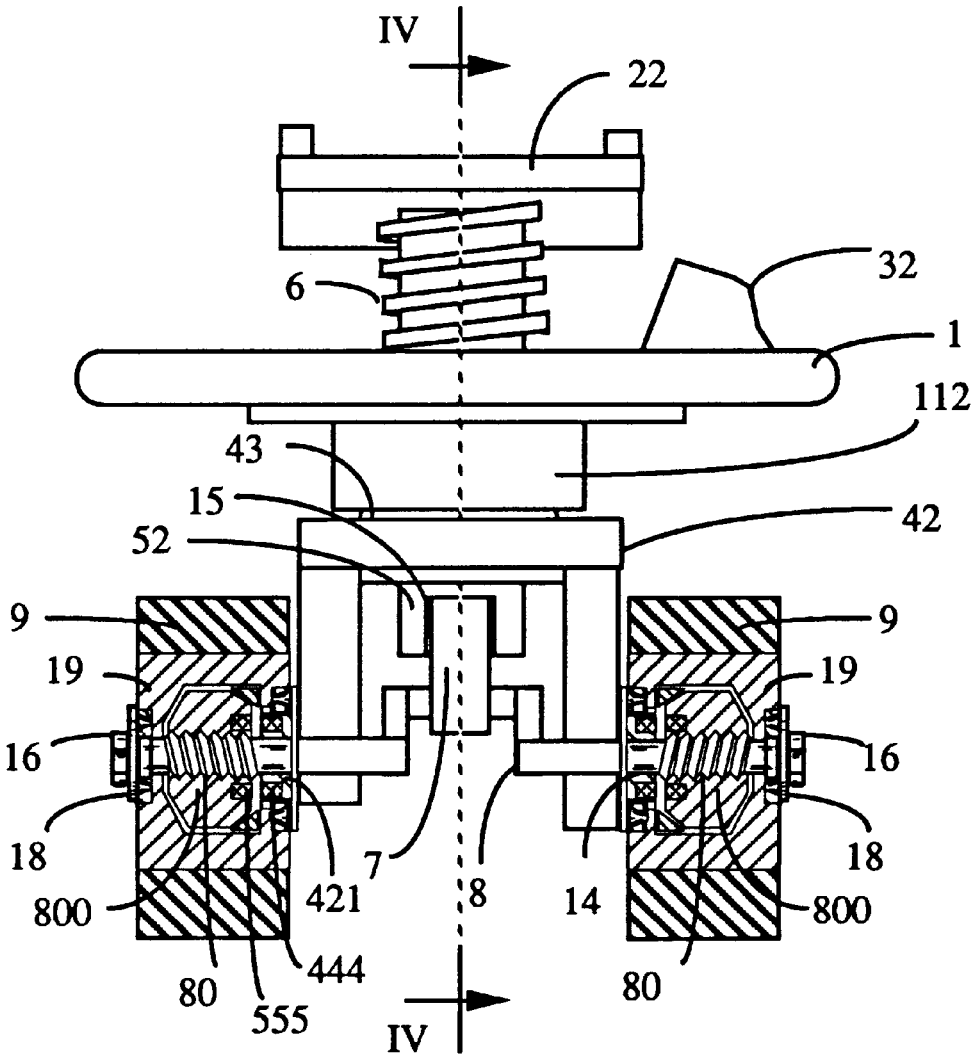

FIG. 4A is the cross section view of the wheel assembly with a pivotal joint; FIG. 4B is the partially exposed section view having the upper-bounded gripping force engaging mechansim embedded in wheel assembly. FIG. 4C is the partially exposed cross section of the noncontact force engaging mechanism embedded in the wheel assembly.

Figure 5C:
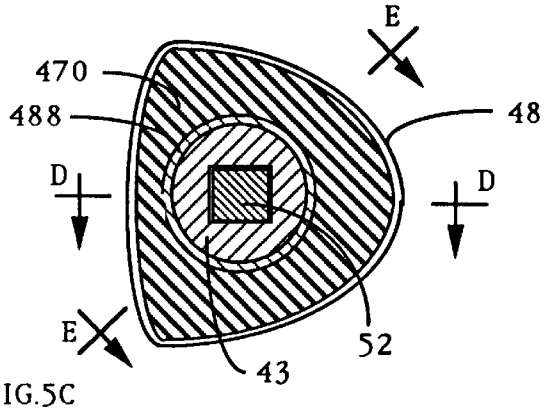
Figure 5D:
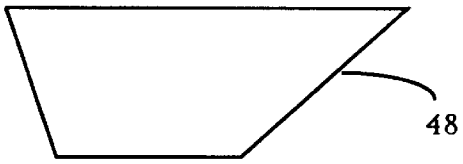
Figure 5E:
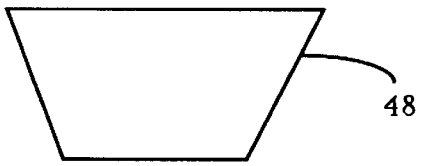
Figure 5B:
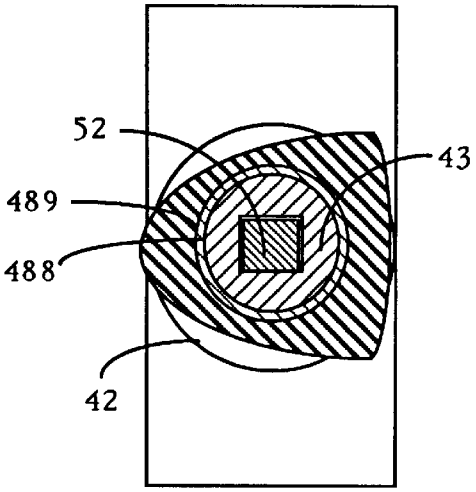
Figure 5A:
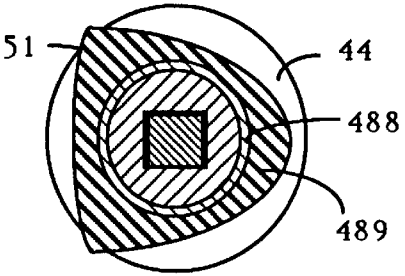

FIG. 5A is the cross section of the pedal rod 51, resilient bushing 489 and the ball joint 44 taken at the cross section V—V in FIG. 3A. Passing through the pivotal joint 43, FIG. 5B is the cross section of the pedal rod 52 taken at the cross section VI—VI in FIG. 4A. FIG. 5C is the resilient joint made of the resilient bushing as shown in FIG. 1D.

Referring to FIG. 3A, the ball joint 44 has the protrude 45. The protrude 45 is enwrapped by the resilient bushing 48. There is a metal bushing 488 between the protrude and the resilient bushing to reduce the friction. The resilient bushing 489 serves as the shock absorber in jumping and enables steering and recovering to straight forward position. The spring 6 is optional. The spring 6 expands to bias against the pedal 21. The pedal rod 51 is pushed up by the spring 6. In FIG. 3A, the link 7 pulls the crankshaft 8 up to the top dead center. The link 70 in FIG. 12 is corresponding to the link 7 in FIG. 3. The tiny slot 79 is optional. In the following discussion, the link 7 having no tiny slot 79 is discussed first.

Figure 12A:
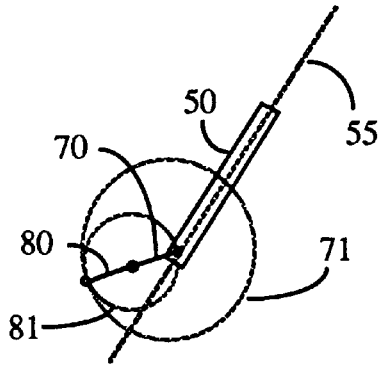
FIG. 12 shows the operation of the crank mechanism: (A) the sliding rod is pushed to the lowest point; (B) the sliding rod is in the middle sliding position; (C) the sliding rod is at the top dead center position; (D) the overlapping configuration of FIG. 12A, FIG. 12B
FIG. 12C shows the trajectory of the crank mechanism.
Figure 12B:
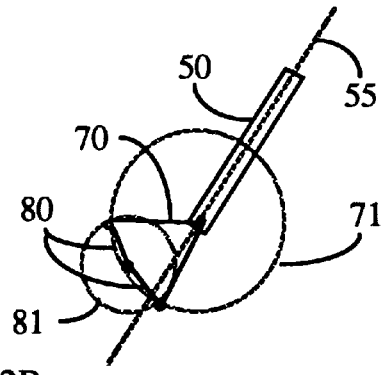
Figure 12C:
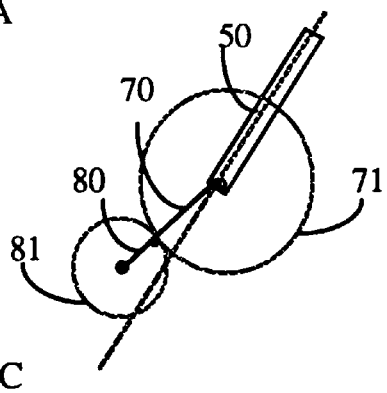
Figure 12D:
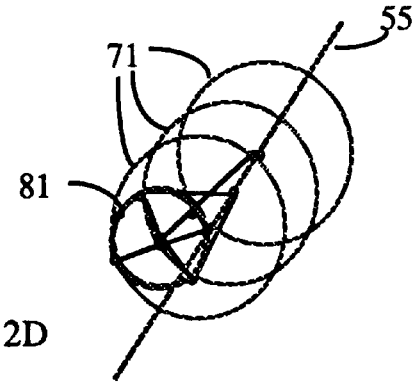

The sliding rod 50 is corresponding to the pedal rod 51; the crank 80 is corresponding to the crankshaft 8. The circle 71 has the link 70 to be radius. The tip of rod 50 is the center of circle 71. The circle 81 has the crank 80 be radius. The circle 71 shifts upward and downward with the rod 50 as shown in FIG. 12D. The position of the link 70 and the crank 80 is determined by the intersection point of the circles 71 and 81. In FIG. 12A, the sliding rod is pushed down to the bottom dead center, the link 70 and the crank 80 coincide with each other. The circle 71 is tangent to the circle 81. There is only one intersection point. In FIG. 12B, the sliding rod 50 is in the middle of the sliding range. The circles 71 and 81 have two intersection points. In FIG. 12C, the sliding rod 50 is pulled up to the top dead center. The crank 80 is in line. The circles 71 and 81 are tangent to each other. There is only one intersection point.

As shown in FIG. 12D, overlapping the circles 71 in FIG. 12A, FIG. 12B and FIG. 12C together, it shows the trajectory of the crank mechanism.

Figure 13A:
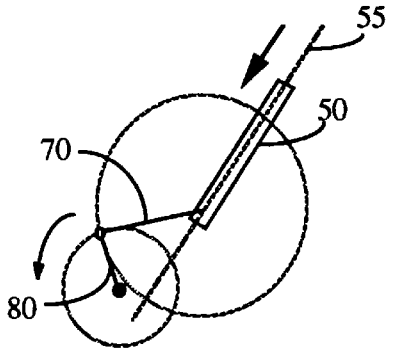
FIG. 13 shows the operation of crank mechansim in the middle range of the upper half working cycle: (A) the sliding rod is pushed downward and the crank rotates counter-clockwise; (B) the sliding rod is pulled upward, the crank rotates clockwise.
Figure 13B:
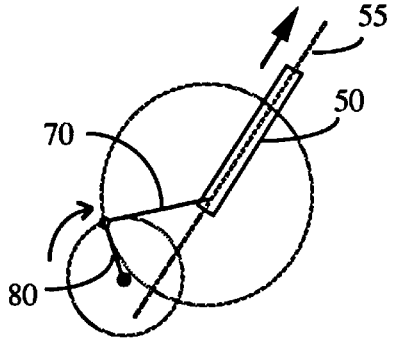

As shown in FIG. 13A, in the upper half cycle, as the sliding rod 50 is pushed downward, the crank 80 rotates counter-clockwise. As shown in FIG. 13B, as the sliding rod 50 is pulled upward, the crank 80 rotates clockwise.

Figure 14A:
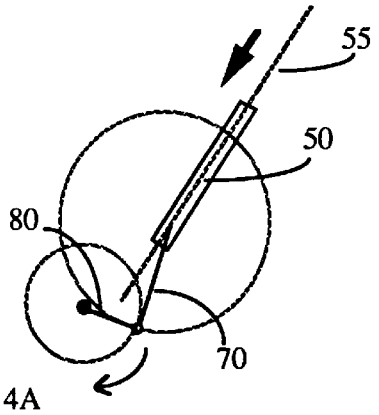
FIG. 14 shows the operation of crank mechansim in the middle range of the lower half working cycle: (A) the sliding rod is pushed downward and the crank rotates clockwise; (B) the sliding rod is pulled upward, the crank rotates counter-clockwise.
Figure 14B:
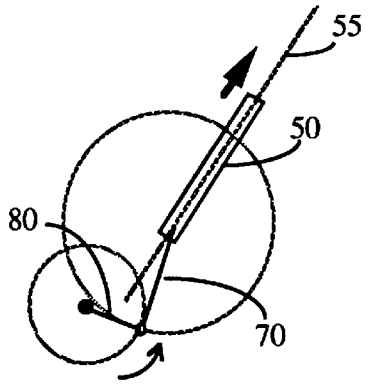

As shown in FIG. 14A, in the lower half cycle, as the slidling rod 50 is pushed downward, the crank 80 rotates clockwise. As shown in FIG. 14B, as the slidling rod 50 is pulled upward, the crank 80 rotates counter-clockwise.

Figure 15A:
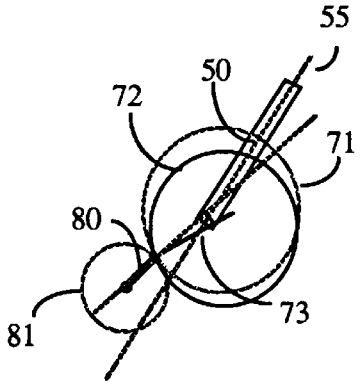
FIG. 15 shows the operation of a single-direction crank mechanism: (A) the sliding rod is at the top dead center; (B) the sliding rod is at the bottom dead center.
Figure 15B:
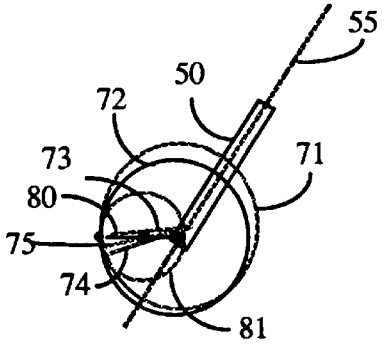

However, pushing the rod 50 down at the top dead center or pulling the rod 50 up at the bottom dead center, the crank 50 cannot decide which direction to rotate. As shown in FIG. 3A, to have the selectivity of rotational direction, there is a tiny slot 79 on the link 7. The pin 15 slides in the slot 79. The slot 79 provides the mechanism to have the selection of rotational direction. The direction selection mechanism is shown in FIG. 15. As the pedal 21 is treaded downward first, the slot 79 enables the crankshaft 8 to rotate forward. The configuration is shown in FIG. 15A. At the top dead center, as the sliding rod 50 is pushed downward, the link 73 rotates and the corresponding new circle 72 has the smaller radius than the original circle 71 does. The circle 72 has two intersections with circle 81. This configuration is similar to FIG. 13A that the crankshaft rotates counter-clockwise. The forward counter-clockwise rotation selective region is the small angle clamped by link 73 and the extension of link 80. As shown in FIG. 15B, at the bottom dead center, there is only one selection of the clockwise rotation, too. As the rod 50 is pulled upward, the circle 71 has the link 75 to be the radius. The tip of link 75 is the intersection of circles 81 and 72. At the bottom dead center, as the sliding rod 55 is pulled upward, the crank 80 rotates clockwise. The tips 73 and 74 are the two intersections of circles 81 and 71. This reverse clockwise rotation selective region is clamped by the link positions 73 and 75. The slot 79 is tiny so that the forward counter-clockwise rotation region and reverse clockwise rotation region are pretty small.

In the continuous cranking motion, the crank 8 rotates and the link 7 swivels. The rotational momentum overcomes the tiny regions to have the continuous cranking rotation. It is noted that as long as the slot 79 is pretty small, the momemtum will enable the crank 7 and link 8 to rotate continuously in the original direction. Unless the rider holds the sliding rod 51 still and starts over again, the direction selectivity will not play its role. The momentum will mask off the direction selectivity function. The crank mechanism will function as the normal cranking mechanism.

There are two ways for the direction selectivity. The first way is dependent on the driving force applied to which side of the top dead center as shown in FIG. 13 and FIG. 14. The second way is, at the top dead center or the bottom dead center, with the tiny slot 79 in FIG. 3A, the user can determine which direction the wheels will rotate as shown in FIG. 15A and FIG. 15B. However, the tiny slot 79 is optional.

In FIG. 3A, the ball joint 44 is an integrated unit with the truck 41 and it fits in the hole inside the seat 111. After steering, to have the wheels automatically line up to go straight forward, the axis of the truck 41 slightly tilts backward. The surface of supporting seat 111 slightly inclines forward. Under the weight of the rider, the wheels 9 point forward automatically and the skateboard skates straight forward.

As shown in FIG. 5C, the resilient bushing 48 is in the shape of parabolic curve. The difference in potential energy predisposes the wheels to point straight forward. As shown in FIG. 5D and FIG. 5E, comparing with the section views at different sections, the wheel will recover to straight forward position after steering.

As the wheels point straight forward, the tilting angle between axis of the truck and the vertical line is the largest angle, The board is at the lowest position and it has the minimum potential energy.

As the wheels point sideward and the axis of truck leans sideward, the angle between axis of the truck and the vertical line becomes smaller. The board will raise up a little and the potential energy is larger.

The tilting effect of the board has a similar effect on steering and the return biasing. During the steering or tilting of the board, the axis of truck will tilt sideward. The angle between the axis of the truck and the vertical line becomes smaller. The board will raise up a little and the potential energy is larger. Because of the potential energy in the gravity field, the energy is stored in the resilient bushing to return biasing. Twisting the pedal 21 can steer the truck 41 and wheels 9. The resilient bushing 48 is deformed as the truck turns. The resilient force in the resilient bushing 48 pushes the truck 41 back to the straight forward position.

As shown in FIG. 29, it shows the mechanism of the steering. The vertical axis 56 correspondes to the axis of truck 41. The horizontal axle 88 correspondes to the crankshaft 8. If the truck axis 56 is vertical, the horizontal axis 88 can rotate 360 degrees as shown by the rotational disk 91 in FIG. 29A. If the truck axis 56 tilts backward with a small angle as shown in FIG. 29B, the corresponding rotational disk 92 tilts slightly backward and makes a tiny angle with the horizontal disk 91. In FIG. 29C, the resilient bushing 489 is deformed and the energy is stored in the resilient bushing such as 489 in FIG. 3A, FIG. 4A and 471, 472 in FIG. 1D. The resilient bushings 489, 471 and 472 enwrap the truck tightly. There is a metal bushing 488 between the truck and the resilient bushing. The metal bushing 488 is integrated with the resilient bushing. The resilient bushing has the multiple functions of anti-shock, steering and recovering to the straight forward position. After the steering, the resilient bushing 489 will expand to push the truck axis 41. The wheel 9 will point to the forward direction automatically and the skateboard will run straight forward again.

There is a design trade-off among the inclination angle of the truck 41, the deformation of resilient bushing 489 and the maximum steering angle. If the inclination angle of truck 41 is zero, the steering angle can be 360 degrees and the truck 41 is free to rotate; the deformation of the resilient bushing 489 is zero. If the inclination angle of truck 41 is large, the truck 41 is difficult to rotate; the turning angle is small. With a proper design trade-off of the inclination angle of the truck 41 and the deformations of the resilient bushing 489, the restoring force of the resilient wheels 9 and bushing 489 will restore the truck 41 back to the straight forward position after steering.

FIG. 3B is the partially exposed view of the wheel assembly having the exposed cross section of the engaging mechanism. To get rid of the friction in the engaging mechanism, the hub is filled with the grease. It is noted that the engaging mechanism is completely different from the conventional brake. In the conventional brake, the grease is not allowed at all.

Figure 16A:
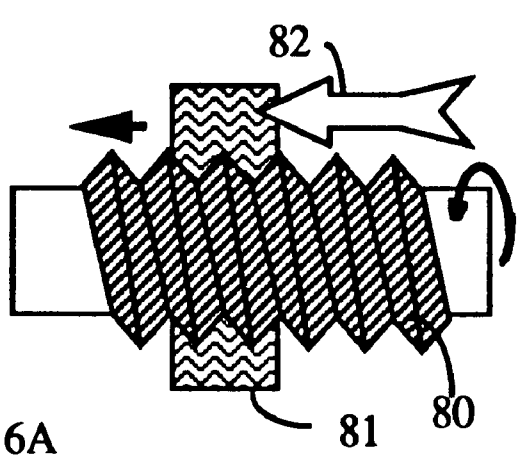
FIG. 16 shows the basic operations of the screw engaging drive mechanism: (A) the engaging drum shifts left as the right-handed screw rotates counter-clockwise; (B) the engaging drum shifts right as the right-handed screw rotates clockwise; (C) the engaging drum shifts left as the engaging drum rotates clockwise; (D) the engaging drum shifts right as the engaging drum rotates counter-clockwise.
Figure 16B:
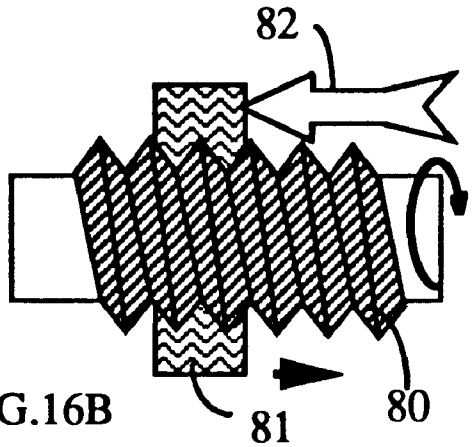
Figure 16C:
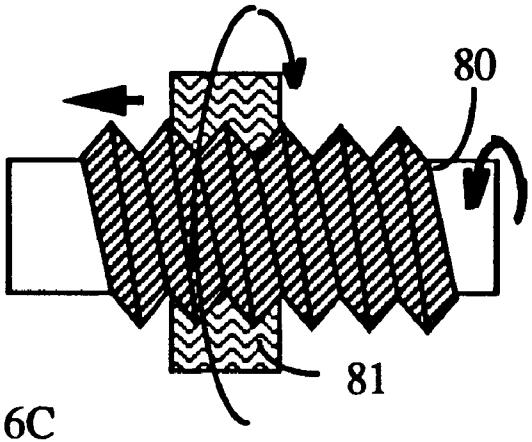
Figure 16D:
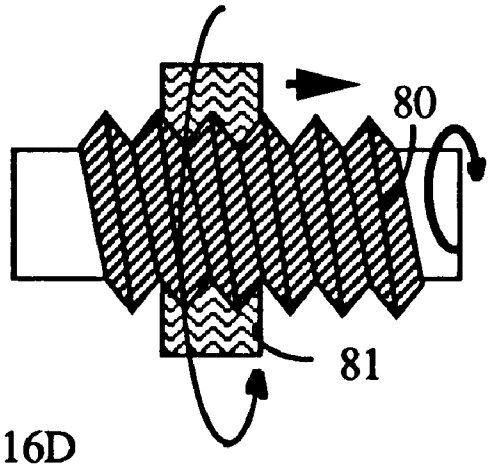

The wheel 9 has the engaging mechanism em bedded in the hub 19. From FIG. 16 to FIG. 28, the principles of the engaging mechanism are illustrated in the figures. FIG. 16 is the basic operations of screw mechanism. In the following description, the rotational direction is described as the direction as seen from the right or looking into the paper. In FIG. 16, the axlewise gripping force 82 applies to hold the engaging drum 81. In FIG. 25, the maximum value of the upper bounded gripping force is shown by the lines 94 and 95. The gripping force is to grip the engaging drum 81. Seen from the right, as the right-hand screw 80 rotates counter-clockwise, the engaging drum 81 shifts left as shown in FIG. 16A. In FIG. 16B, as the screw 80 rotates clockwise, the engaging drum 81 shifts right. In FIG. 16C, the engaging drum 81 rotates clockwise relative to the screw 80, the engaging drum 81 shifts left. In FIG. 16D, the engaging drum 81 rotates counter-clockwise relative to the screw 80, the engaging drum 81 shifts right. From FIG. 17 to FIG. 28, the basic operations of screw mechanism are further extended to be the operations of engaging drive to drive the wheel.

In the following descriptions, the left-half wheel 83 is held not to move in the lateral direction. The screw is notched on the shaft 80. As shown in the FIG. 2 of Schmitz's patent, the spring clip finger portion 20 uses the radial friction force, the finger 20 is easily broken. In my invention, the gripping force uses the upper-bounded axlewise gripping force, not the friction force. The hub is filled with grease so that the friction is eliminated. The gripping spring 87 expands against the truck 86 and the engaging drum 81 to apply the upper-bounded axlewise gripping force to the engaging drum 81. Adapting to the shift of engaging drum 81, the engaging spring 87 can adjust its length to apply the gripping force to the engaging drum 81. The protrude 142 fits in the slot 422 that the upper-bounded gripping force is generated.

Furthermore, I make an innovation using a noncontact force. The noncontact force may be either electrical force or magnetic force. The poles of noncontact force generate the field to grip the engaging drum.

As the engaging drum does in FIG. 16A, in FIG. 17A, as the engaging drum 81 shifts left, the engaging drum 81 squeezes the left-half wheel 83 and engages with the left-half wheel 83. Under the driving force of shaft 80, the left-half wheel 83 rotates counter-clockwise. As shown in FIG. 25, during engagement, the wedge force 96 overcomes the gripping force 94 to drive the left-half wheel 83.

FIG. 18 shows the engaging drum 81 disengaging with the left-half wheel 83. There is a gap between the left-half wheel 83 and the engaging drum 81. The wheel 83 is free to rotate. There are three ways to have the disengagement as shown in FIG. 19.

In FIG. 19A, the left-half wheel 83 rotates counter-clockwise; the shaft 80 is held still. At the beginning, the engaging drum 81 engages with the wheel 83. As the left-half wheel 83 rotates counter-clockwise, the engaging drum 81 rotates together with left-half wheel 83. According to FIG. 16D, the engaging drum 81 rotates and shifts right to disengage with the wheel 83 as shown in FIG. 18. The left-half wheel 83 is free to run.

In FIG. 19B, the engaging drum 81 engages with the left-half wheel 83. The left-half wheel 83 rotates counter-clockwise and the screw 80 rotates clockwise. As the left-half wheel 83 rotates counter-clockwise, according to FIG. 16D, the engaging drum 81 shifts right and disengages with the wheel as shown in FIG. 18. The left-half wheel 83 is free to run.

In FIG. 19C, the left-half wheel 83 is still; the engaging drum 81 is held by the gripping force 82. At beginning, the engaging drum 81 engages with the left-half wheel 83. As the screw 80 rotates clockwise, according to FIG. 16B, the engaging drum 81 shifts right and disengages with left-half wheel 83 as shown in FIG. 18. The left-half wheel 83 is free to run.

FIG. 20 is the conjugate case of FIG. 17 for the right-half wheel; FIG. 21 is the conjugate case of FIG. 18; FIG. 22 is the conjugate case of FIG. 19.

In FIG. 20, the right-half wheel 85 is held not to move in the lateral direction. As the engaging drum 81 shifts right, the engaging drum 81 squeezes the right-half wheel 85 and engages with the right-half wheel 85 to be one unit. As shown in FIG. 25, during engagement, the wedge force 97 overcomes the gripping force 95 to drive the wheel 83 to rotate. Under the driving force of screw 80, the right-half wheel 85 rotates together with the engaging drum 81 and the shaft 80.

FIG. 21 shows the engaging drum 81 disengaging with the right-half wheel 85. The right-half wheel 85 is free to rotate. There is a gap between the right-half wheel 85 and the engaging drum 81. As shown in FIG. 22, there are three ways to have the disengagement.

Figure 22C:
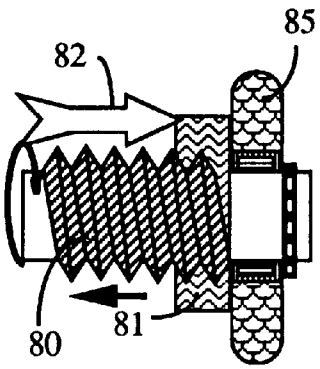
Figure 22B:
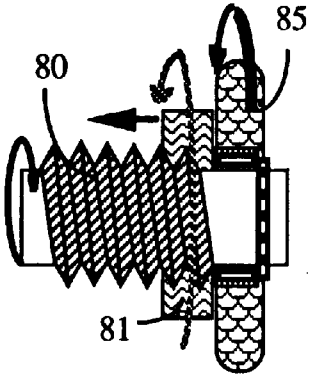
Figure 22A:
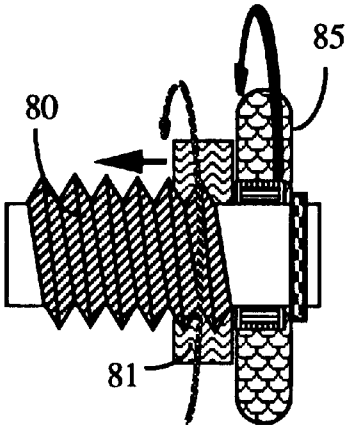

In FIG. 22A, the engaging drum 81 engages with the right-half wheel 85; the right-half wheel 85 rotates clockwise; the screw 80 is held still. As the right-half wheel 85 rotates counterwise, according to FIG. 16C, the engaging drum 81 shifts right and disengages with the the right-half wheel 85 as shown in FIG. 21. The right-half wheel 85 is free to run.

In FIG. 22B, the right-half wheel 85 rotates clockwise; the engaging drum 81 engages with the right-half wheel 85; the screw 80 rotates counter-clockwise. As the right-half wheel 85 rotates clockwise, according to FIG. 16C, the engaging drum 81 shifts left and disengages with the right-half wheel 85 as shown in FIG. 21. The right-half wheel 85 is free to run.

In FIG. 22C, the engaging drum 81 engages with the right-half wheel 85; the screw 80 rotates counter-clockwise-; the engaging drum 81 is held by the gripping force 82. According to FIG. 16A, the engaging drum 81 shifts left and disengages with the right-half wheel 85 as shown in FIG. 21. The right-half wheel 85 is free to run.

Furthermore, as shown in FIG. 23, the left-half wheel 83 and right-half wheel 85 are merged to be one single wheel 84. In FIG. 17, the wheel 83 is driven to rotate counter-clockwise; in FIG. 20, the right-half wheel 85 is driven to rotate clockwise. In FIG. 18 and FIG. 21, the left-half wheel 83 and right-half wheel 85 are free to run. So the combinatory wheel 84 is able to drive clockwise, counter-clockwise and free to run. These three basic operations can be used as the modes of forward drive, backward drive, free-run, speed-up, deceleration and brake. The gripping spring 87 in FIG. 23 is equivalent to the gripping force 82 as shown in FIG. 16 to FIG. 22.

Figure 23D:
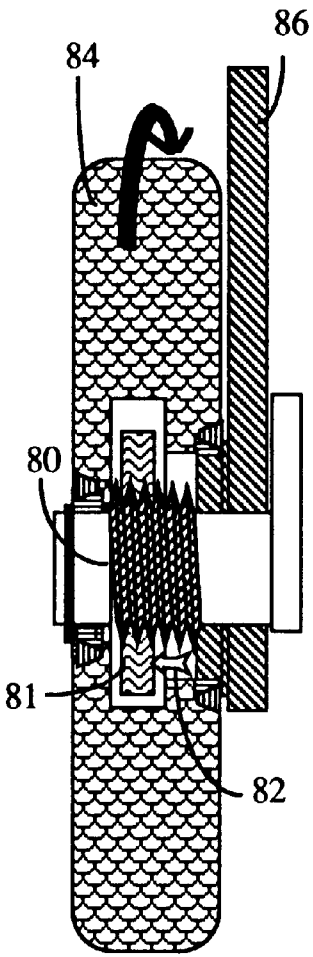
Figure 23C:
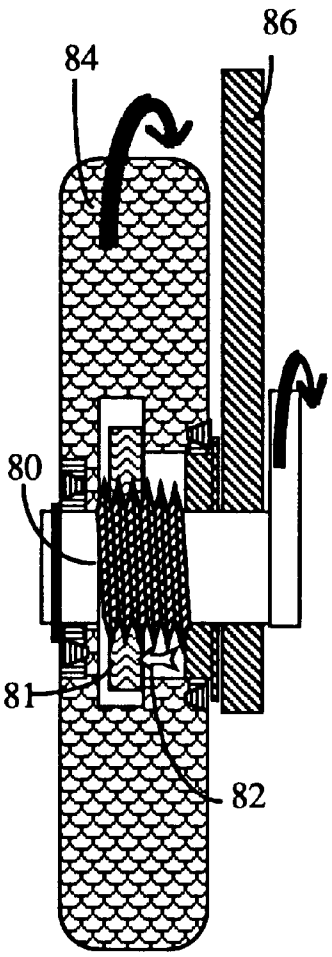
Figure 23B:
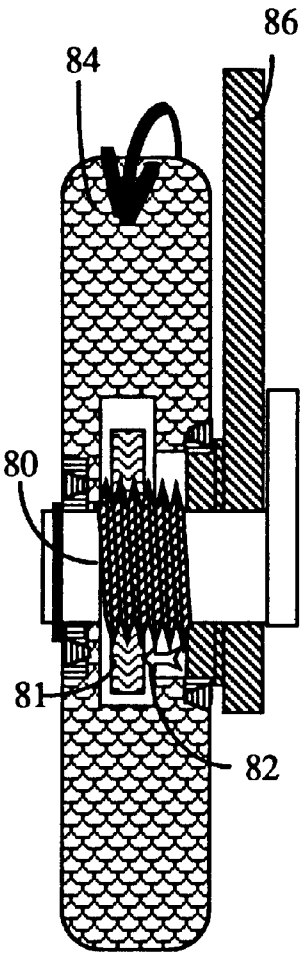
Figure 23A:
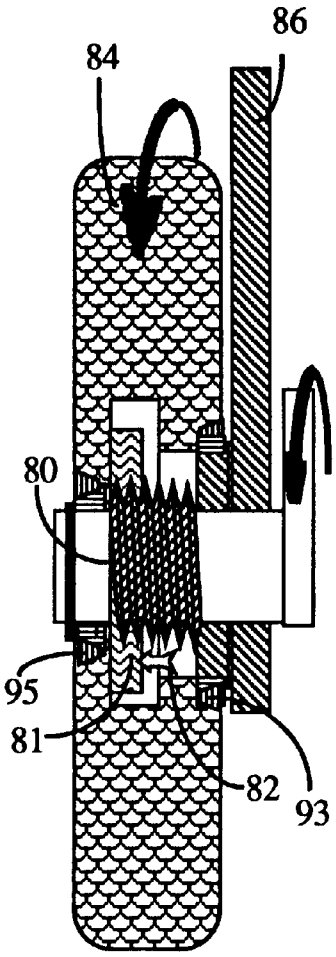

In FIG. 23A, the crankshaft 80 rotates counter-clockwise. The engaging drum 81 shifts left to engage with the combined wheel 84 at the left side of engaging drum 81. The engaging drum 81 squeezes the wheel 84 and engages with the wheel 84. As shown in FIG. 25, the engaging wedge force 96 overcomes the gripping force 94 applied on the engaging drum 81. The crankshaft 80 drives the engaging drum 81 and wheel 84 to rotate counter-clockwise.

In FIG. 23B, the wheel 84 rotates counter-clockwise. However, the crankshaft 80 is held still. As shown in FIG. 25, the wedge force 96 decreases with the clockwise rotation of wheel. As shown in FIG. 19A, the engaging drum 81 shifts left and disengages with the wheel 84. Finally, the frictional force 94 of spring 87 holds the engaging drum 81 still. The engaging drum 81 disengages with the wheel 84. The wheel 84 is free to run.

If the crankshaft 80 starts to rotate counter-clockwise, as shown in FIG. 23A, the wheel will be driven to rotate counter-clockwise again. This is the acceleration mode.

In FIG. 23C, the crankshaft 80 rotates clockwise. The engaging drum 81 shifts right and engages with wheels 84. The wheel 84 is locked with the engaging drum 81. As shown in FIG. 25, the engaging wedge force 97 overcomes the gripping force 95 applied on the engaging drum 81. The crankshaft 80 drives the engaging drum 81 and wheel 84 to rotate clockwise.

To minimize the friction force, noncontact force is used. The noncontact force may be either electrical force or magnetic force. The design of the engaging mechanism of magnetic force is much simpler than the design of electrical force. In the following discussions, the word "noncontact" may be exchanged with the word of "magnetic" or "electrical".

As shown in FIG. 26, the noncontact poles 444 are buried in the frame of truck 411 and the noncontact poles 555 are buried in the engaging drum 800. FIG. 26D shows one possible implementation of the noncontact gripping force engaging mechanism.

The noncontact force is as shown in FIG. 27A. The "m" is the number of noncontact poles distributed on the peripheral. As shown in FIG. 27B, the noncontact force holds the engaging drum during the axle 80 rotating. As the engaging drum 800 engages with the hub 19, the engaging wedge force overcomes the noncontact force to drive the wheel to rotate. The gripping force is very small. However, the mass of rider is large. The momentum of the rider will serve as the "fly wheel" to smooth the riding.

Figure 24B:
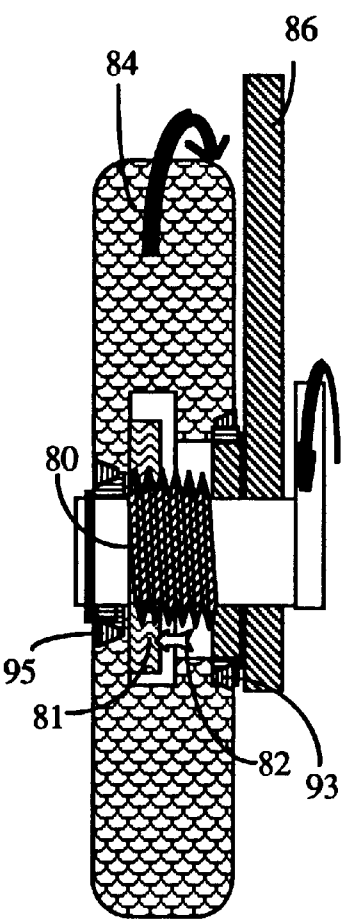
Figure 24A:
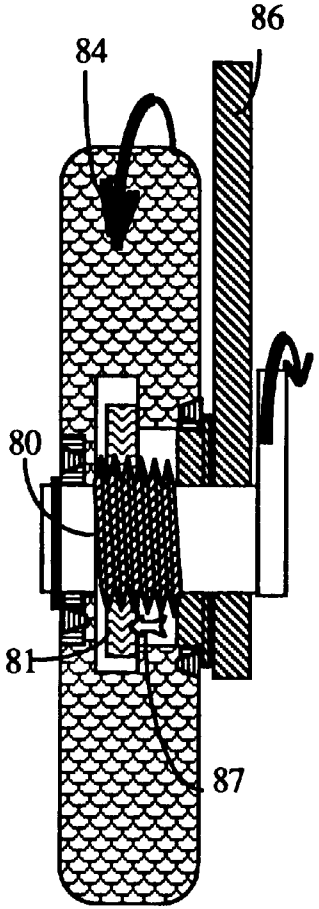

This invention adopts the novel design of engaging mechanism such that it has a lot of novelties. FIG. 28 shows the state diagram of the engaging mechanism. DF is the state of driving forward as shown in FIG. 23A; FF is the free-running mode as shown in FIG. 23B; DB is the driving backward mode as shown in FIG. 23C; FB is the backward free-running mode as shown in FIG. 23D; BF is the braking mode in the forward running as shown in FIG. 24A; BB is the braking mode in the backward running as shown in FIG. 24B.

At the beginning, as shown in FIG. 23C, the engaging drum 81 engages with the wheel 84 and is locked with the wheel 84. As the wheel 84 rotates clockwise and the crankshaft 80 is held still as shown in FIG. 23D, the engaging drum 81 disengages with the wheel 84.

FIG. 23A is the mode of skating forward. FIG. 23C is the mode of skating backward. FIG. 23B is the free-running mode in forward skating. FIG. 23D is the free-running mode in backward running. With such a way of the cyclic operations of FIG. 23, the wheel 84 may be driven to skate forward, backward and free to run. With these three basic operations, the skateboard can have the modes of driving forward, driving backward, free running, deceleration and braking.

The transition from FIG. 23A to FIG. 24A is the brake mode in forward skating. The crankshaft 80 is held still and t he engaging drum is self-locked with wheel. In the decelerate mode, the crankshaft 80 is allowed to rotate under the damping force of the feet.

The transition from FIG. 23C to FIG. 24B shows the braking mode in the backward skating. The crank shaft 80 is held still. The engaging drum is self-locked with wheel. In the deceleration mode, the crankshaft 80 is still allowed to rotate under the damping force of the feet.

In the deceleration mode and braking mode, the wheel 84 is self-locked with the engaging drum 81 and the shaft 80. For this self-locked mechanism, the braking force comes from the self-locking force. In FIG. 24A, after the wheel 84 being braked to stop in backward skating, the wheel 84 may skate forward as shown in FIG. 23A. In FIG. 24B, after the wheel 84 being braked to stop in forward skating, the wheel 84 may skate backward as shown in FIG. 23C.

In FIG. 3, the above novel designs are applied to the wheel design. The axle of crankshaft 8 has shift screws 80. The bevel bearing 18 and the locking nut 16 hold the wheels 9 to the crankshaft 8. The shift screw 80 shifts the engaging drum 810 to engage or disengage with the hub 19. The axle 8 is supported by bevel bearings 18 in the hub 19. In the engaging position, the engaging drum 810 squeezes the hub 19 with the wedging force and is self-locked.

Figure 8A:
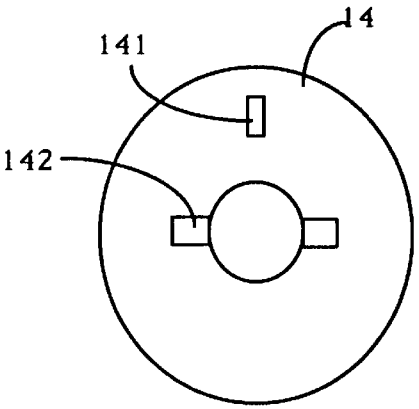
FIG. 8 (A) shows the top view of the gripper, (B) shows the section view of the gripper.
Figure 8B:
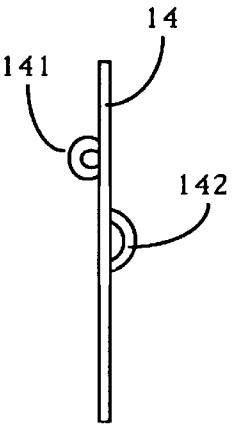
Figure 7:
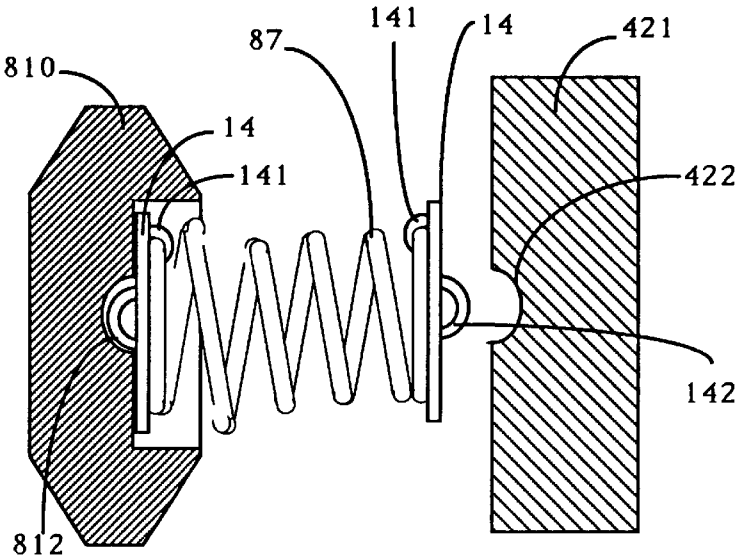
FIG. 7 shows the section view of the upper bounded axlewise force engaging mechanism.

As shown in FIG. 7, the gripping spring expands to apply the gripping force. The gripper 14 has the protrude 142 and the frame 421 of the truck has the gripping slot 422. FIG. 8 shows the detailed design of the gripper 14. The gripping spring 87 is hooked in the notch 141. As the protrude 142 fits in the slot 422, the engaging drum 811 is held by the gripping force of the gripping spring 87. The gripping spring 87 holds the engaging drum 810 that the drum 810 can be shifted left and right as shown in FIG. 23 and FIG. 24.

From FIG. 12 to FIG. 28, the working principles of the skateboard have been shown in the figures. Referring to FIG. 13A, FIG. 15A and FIG. 14B, steping on the pedal may drive the crank 8 to rotate counter-clockwise to skate forward. Referring to FIG. 16A, FIG. 17, FIG. 23A and FIG. 28, as the crankshaft 8 rotates counter-clockwise to drive the wheel 9 to rotate forward, the shift screw 80 shifts the engaging drum 810 until it engages with the hub 19. In the engagement, the crankshaft 8 drives the wheel 9 to rotate. Referring to FIG. 19A, FIG. 18, FIG. 23B and FIG. 28, the pedal 21 holds the crankshaft 8 still. The forward rotation of the wheel 9 releases the lock between the hub 19 and the engaging drum 810. The wheel 9 rotates in the disengagement position. The skateboard is free to run without making any noise.

There are two ways to initiate the clockwise rotation in the counter-clockwise rotation of forward driving. The first way is, as shown in FIG. 13A, in the half-way of stepping pedal 21 downward, raise up the pedal or release the pedal 21. The pedal rod 51 is pulled up and the crank shaft 8 rotates clockwise as shown in FIG. 13B. The second way is: as the pedal moves up as shown in FIG. 14B, tread the pedal 21 downward as shown in FIG. 14A. The crankshaft 8 rotates clockwise. After the reversal clockwise rotation is initiated, due to the momentum of link 7 and crankshaft 8, continuing stepping on the pedal 21, the crankshaft 8 rotates in the direction of reverse clockwise rotation. As the crankshaft 8 rotates in the clockwise direction, as shown in FIG. 24C, the shift screw 80 shifts the engaging drum 81 to engage with the hub 19. The wheel rotates to drive the skateboard backward.

There are two ways to initiate the counter-clockwise rotation in the clockwise rotation of backward driving. The first way is, as shown in FIG. 14A, in the half-way of stepping downward motion, raise up the pedal or release the stepping pedal 21. The pedal 21 is pulled upward and the crank shaft 8 rotates counter-clockwise as shown in FIG. 14B. The second way is: during the pedal moving upward as shown in FIG. 13B, tread the pedal downward as shown in FIG. 13A. The crankshaft 8 rotates counter-clockwise. After the counter-clockwise rotation is initiated, due to the momentum of link 7 and crankshaft 8, continuing stepping on the pedal 21, the crankshaft 8 rotates in the counter-clockwise rotation. As the crankshaft 8 rotates in the counter-clockwise direction, as shown in FIG. 23A, the shift screw 80 shifts the engaging drum 810 to engage with the hub 19. The wheel rotates to drive the skateboard forward.

As shown in FIG. 23 and FIG. 24, the reverse rotation of crankshaft 80 may be used to brake the skateboard in the forward driving and vice versa. As the wheel 84 is in the forward rotation, the reverse rotation of the crankshaft 80 disengages the engaging drum 81 first as shown in FIG. 23B. As shown in FIG. 3, the gripping force holds the engaging drum 810. Similar to FIG. 24A, in FIG. 3, the rotation of the shift screw 80 shifts the engaging drum 810 to engage the hub 19. The engaging drum 810 engages and locks the hub 19. Referring to FIG. 25, the wedging force 97 overcomes the gripping force 95 and drives the wheel 9 to rotate in the clockwise rotational direction. The clockwise rotation serves as the brake and the decelerating means for the skateboard.

As the wheel 9 is in a backward clockwise rotation, the forward counter-clockwise rotation of the crankshaft 80 disengages the engaging drum 81 first as shown in FIG. 23D. As shown in FIG. 3, the gripping force holds the engaging drum 810. Similar to FIG. 24B, in FIG. 3, the counter-clockwise rotation of the shift screw 80 shifts the engaging drum 810 to engage with the hub 19 on the outer side of the engaging drum 810. The engaging drum 810 engages and locks the hub 19. Referring to FIG. 25, the wedging force 96 overcomes the gripping force 94 and drives the wheel 9 to rotate in the counter-clockwise direction.

As shown in FIG. 3A and FIG. 5, the wheel assembly having the ball joint 44 can drive and turn direction simultaneously. Twisting the sliding pedal rod 51, the truck 41 swivels to turn direction. As the sliding pedal rod 51 slides upward and downward, the crankshaft 80 rotates to drive the wheels.

Figure 6:
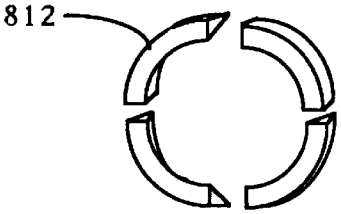
FIG. 6 shows the perspective view of the sealing wedge blocks.

As shown in FIG. 4A and FIG. 6, the wheel assembly having the pivotal joint 43 can drive and turn direction simultaneously. Turning the sliding rod 52, the frame 42 swivels to turn right and left. As the sliding rod 52 slides upward and downward, the crankshaft 80 rotates clockwise and counter-clockwise.

Furthermore, the engaging mechanism enables the two wheels to be driven with different rotation speeds. It is the continuous undivided axle having the differential drive. During the turning direction, the inner wheel rotates slower than the outer wheel. The inner wheel still engages with the crankshaft 80 in the driving mode. The outer wheel runs faster than the rotational speed of inner wheel and the crankshaft 80. The crankshaft 80 disengages the outer wheel. The outer wheel is in the free-running mode. So this wheel assembly is referred as the simultaneously steering and synchronous differential driving mechanism.

FIG. 4 shows the alternative design of the simultaneously steering and synchronous differential driving mechanism. In FIG. 4A, the truck 42 slightly inclines forward and the surface of supporting seat 112 slightly incline backward. Under the weight of the rider, the wheel points backward to keep running straight forward. The pivotal joint 43 is a unit with the truck 42. The flange 10 holds the resilient bushing 49 inside the seat 112. On the link 7, there is a pin hole.

As the rear pedal 22 is treaded downward, the crankshaft 8 may rotate either backward or forward. In the forward running mode, the reversal rotation may serve as the brake mechanism; in the backward running mode, the forward rotation may serve as the brake mechanism. To convert the axlewise engaging force to be the radially engaging force, the engaging drum 810 and the hub 19 adopt the wedges structure. Furthermore, as shown in FIG. 6, to make the assemble easier, the wedge blocks 812 are inserted to seal the engaging drum 811 inside the hub 19. The hub is filled with grease; the wedge block is not brake. The wedge block is to make the assembly work easier. As the crankshaft 8 rotates backward, the engaging drum 810 squeezes the wedge blocks 812 with the wedge force. The wedges 812 expand outward and engage with the hub 19. The wheel will rotate backward.

In FIG. 4C, the noncontact poles 444 use the noncontact gripping force to grip the engaging drum. The noncontact poles 444 are embedded in the frame 421; the noncontact poles 555 are embedded in the engaging drum 800. The noncontact force grips the engaging drum 800 during the axle 810 rotating to drive the wheels.

This skateboard is adaptable to operate in the field having rough road conditions. In this novel skateboard design, all the complex driving and steering mechanism is enveloped in the seats 111 and 112; all the complex engaging mechanism is enveloped in the hub 19. Looking from the outside, the mechanism is pretty simple. Furthermore, the rider does not need to use the foot to push against the ground. The skateboard may ride in the snowy, icy or muddy road conditions.

Figure 10B:
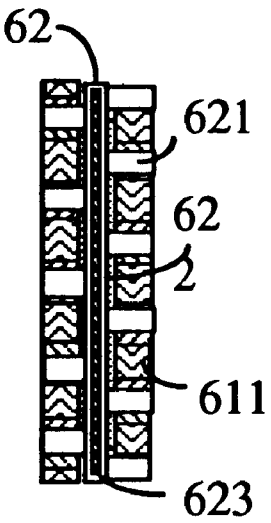
FIG. 10 (A) is the front view of the sprocket wheel having alternating teeth; (B) is the sprocket wheel having alternating teeth and the flexible belt having alternating fingers.
Figure 10A:
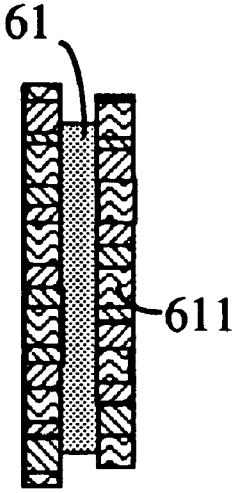
Figure 9B:
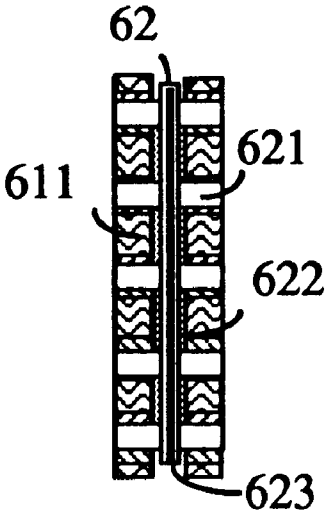
FIG. 9 (A) is the front view of the sprocket wheel having aligned teeth; (B) is the sprocket wheel having aligned teeth and the flexible belt having aligned fingers; the aligned fingers arc fitted in the grooves between aligned teeth.
Figure 9A:
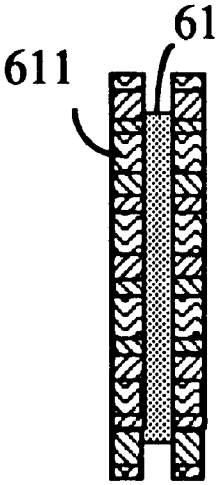

To ride in a rough road condition, the wheel of the skateboard adopts the groovy sprocket wheel 61 having the teeth 611 as shown in FIG. 1E, FIG. 9A and FIG. 10A. To ride the skateboard on the snow, the skateboard adopts the flexible belt 62 as shown in FIG. 1E, FIG. 9B, FIG. 10B and FIG. 30.

Referring to FIG. 28, the flexible belt 62 is composed of the flexible steel string 623, polyurethane tube 622, fingers 621 and the supporting shoes 624 and 625. To enable the belt 62 to have the lateral flexibility, the tension supporting material is just a flexible string 623 which has the flexibility in all direction. The enveloping tube 622 for the string is divided into several small segments as shown in FIG. 28A. Between the successive shoes, the fingers arc kept clear from each other. The supporting shoes 624 and 625 can slide over each other. So the flexible belt still keeps the lateral flexibility.

Figure 11:
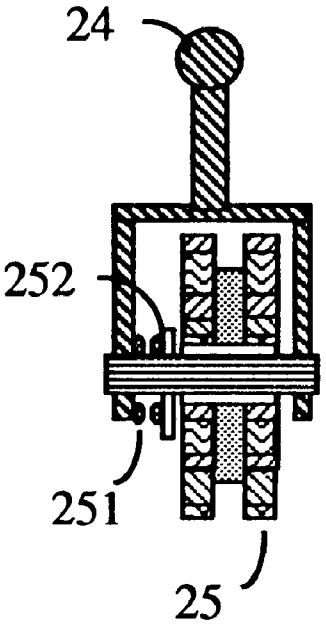
FIG. 11 is the section view of the sprocket gear to keep the flexible belt in tension.

The turning angle in steering is kept small. In steering, the variance of distance between the front and the rear wheels is small. The directional change of the belt is tiny. The changes of length and direction of belt are adjusted with the dangling sprocket gear 25 as shown in FIG. 11. The dangling sprocket gear 25 is mounted beneath the board 1 with the universal joint 249. As shown in FIG. 1E, the bias spring 248 applies the pressure to the dangling sprocket gear to have the constant contact with the belt 62. As shown in FIG. 11, the biasing spring 251 introduces the biasing force to the dangling sprocket gear 25. As shown in FIG. 8, as the skateboard moves left and the belt moves counter-clockwise. The upper belt moves left and pulls the right dangling sprocket 25. The biasing force introduced by the biasing spring 251 enables the dangling level rotating downward. The dangling sprocket gear 25 squeezes the upper belt. The belt 62 is kept in tension. If the skateboard moves right and the belt moves clockwise, the upper belt moves right and pulls the left dangling sprocket 25 to squeeze with the upper belt. In such a way, the belt 62 is kept in tension, too. So the belts will enwrap the wheels in either forward or backward skating. While turning direction, the outer wheels pull the belt in both directions. The right and left dangling sprocket gears 25 are raised up to adjust for the larger pitch between two wheels. However, as the belt moves, one of the dangling sprocket gears will force the belt to be in tension. The belt 62 is in tension that the belt 62 enwraps on the wheels 61. The flexibility of belt enables the belt 62 to adjust the small change of direction in steering. The universal joint 24 adjusts the change of the belt length and always keep the belt in tension. With the above design, the belts are kept to enwrap on the wheel 61 during steering. The fingers 621, the shoes 624 and 625 support the weight of rider and increase the grasping force to the ground. To increase the smoothness in riding, as shown in FIG. 10A, the sprocket wheel adopts the alternating teeth pattern. As shown in FIG. 10B, the fingers of flexible belt have the alternating finger structure.

Although the description above contains many specificities, these should not be construed as limiting the scope of the invention but as merely providing illustrations of some of the presently preferred embodiments of this invention. Thus the scope of the invention should be determined by the appended claims and their legal equivalent, rather than by the examples given.

What I claim is:

1. An undivided continuous axle differential transmission drive apparatus comprises a frame means, a plurality of wheels being rotationally mounted on an undivided continuous axle with a plurality of differential drive means, said undivided continuous axle being rotationally mounted on said frame, said differential drive means being mounted at a hub of each said wheel, said undivided continuous axle being rotationally mounted on said wheels passing through said differential drive means; inside each of said differential drive means, a differential matching screw being notched on said undivided continuous axle;

said differential drive means comprising a hub body, an engaging drum an d a gripping means for said engaging drum; said hub body being rotationally mounted on said undivided continuous axle an d said frame;

for each of said differential drive means, said engaging drum being rotationally mounted on said differential matching screw of said undivided continuous axle; as said engaging drum engages with said hub body, said wheel being driven to rotate by said undivided continuous axle; as said undivided continuous axle driving said wheels to rotate first, then said undivided continuous axle slowing down rotating speed, each of said differential matching screws on each end of the continuous axle having opposite screw directions such that all said wheels are released to be free running;

said gripping means attached to said frame to apply gripping force to grip said engaging drum during rotation of said undivided continuous axle; as said undivided continuous axle rotates in a forward direction, said engaging drum being shifted to move by said differential matching screw in one direction, as said engaging drum engages with said hub body, said wheel being driven to rotate in forward direction; as said undivided continuous axle rotates in reverse direction, said engaging drum being shifted by said differential matching screw to move in another direction, as said engaging drum engages with said hub body, said wheel being driven to rotate in reverse direction;

said undivided continuous axle differential transmission drive having transmission functions of running forward, running backward, free-running and differential function that wheels have different rotating speeds; said wheels having different rotating speed being in differential drive mode: as said undivided continuous axle rotates slower than said wheels, said wheels are disengaged and free-running; when said wheels have different rotating speeds, said undivided continuous axle driving said wheel having slower rotating speed; said engaging drum engaging with said hub to drive said wheel having slower rotating speed; said undivided continuous axle releasing said wheel having faster rotating speed; said engaging drum to be shifted backward to disengage with said hub to allow said wheel having faster rotating speed being free to run;

said undivided continuous axle differential transmission drive having anti-ice-skidding capability, as a vehicle spinning on ice, wheels on outside curve rotating faster than wheels at spinning center, said undivided continuous axle differential transmission drive releasing faster wheels and transmitting power to slower wheels to counter-balance of spinning momentum to pull out said vehicle from spinning and regain control of said vehicle;

said undivided continuous axle differential transmission drive having anti-sand-trapping capability, as said vehicle being trapped in sand, wheels having less frictional pulling force rotating faster than wheels having larger frictional pulling force, said undivided continuous axle differential transmission drive releasing faster wheels and transmitting power to slower wheels to gain more pulling force to pull out said vehicle from sand trap.

2. An undivided continuous axle differential transmission drive apparatus according to claim 1 said frame means has a pivot joint means at top to support an elongated board means, a sliding link means passing through a slot inside said pivot joint means, twisting said sliding link, said frame rotating to steer said wheel to turn in new direction;

said undivided continuous axle having a crank portion, a floating link connecting said sliding link with said crank portion;

a pedal means being mounted at the top of said sliding link, a spring means biasing against said pedal to restore said pedal means to top position; treading on said pedal, said sliding link driving said floating link to rotate said undivided continuous axle to drive said wheels;

said sliding link means being able to drive said undivided continuous axle to rotate forward, backward and hold still;

during running, holding said pedal still, said undivided continuous axle being held still and said wheels being released to be free-running;

during running, driving said undivided continuous axle to rotate in reverse direction, said wheels being braked to stop;

during running, as said pedal rotating 180 degrees, said wheel being braked to stop;

treading on said pedal and twisting said pedal, said undivided continuous axle differential transmission drive apparatus driving and turning direction simultaneously, said wheel on outside curve being released to rotate faster, a swiveling movement of said undivided continuous axle and friction on ground speeding said wheels on outside curve to spin faster to have differential drive of said wheels.

3. An undivided continuous axle differential transmission drive apparatus according to claim 1 of which said gripping means comprises a spring means biasing against said engaging drum to grip said engaging drum.

4. An undivided continuous axle differential transmission drive apparatus according to claim 1 of which said gripping means comprises a spring means biasing against a plate means, said plate means having a protrude means to fit in a recess means on a surface of said engaging drum to grip said engaging drum.

5. An undivided continuous axle differential transmission drive apparatus according to claim 1 of which said gripping means comprises poles of noncontact force, said poles embedded in said frame and said engaging drum separately, said poles of noncontact force generating noncontact force to grip said engaging drum.

6. An undivided continuous axle differential transmission drive apparatus according to claim 5 of which said poles of noncontact force are magnetic poles.

7. An undivided continuous axle differential transmission drive according to claim 1 of which said engaging drum comprises the wedge edge means to engaging with said hub portion with wedge force.

8. An undivided continuous axle differential transmission drive apparatus according to claim 7 of which said engaging drum further comprising a plurality of ring segments of wedge means to engage with said hub portion.

9. A synchronous steering differential transmission drive apparatus comprises a frame means, a plurality of wheels being rotationally mounted on an undivided continuous axle with a plurality of differential drive means, said frame means has a pivot joint means at top to support an elongated board means, a sliding link means passing through a slot inside said pivot joint means, twisting said sliding link causes said frame to rotate to steer said wheel to turn in new direction;

said undivided continuous axle being rotationally mounted on said frame, said differential drive means being mounted at a hub of each said wheel, said undivided continuous axle being rotationally mounted on said wheels passing through said differential drive means; inside each of said differential drive means, differential matching screw are notched on said undivided continuous axle;

said differential drive means comprising a hub body, an engaging drum and a gripping means for said engaging drum; said hub body being rotationally mounted on said undivided continuous axle and said frame;

for each of said differential drive means, said engaging drum being rotationally mounted on said differential matching screw of said undivided continuous axle; as said engaging drum engages with said hub body, said wheel being driven to rotate by said undivided continuous axle; as said undivided continuous axle driving said wheels to rotate first, then said undivided continuous axle slowing down rotating speed, each of said differential matching screws on each end of the continuous axle having opposite screw directions such that all said wheels are released to be free running;

said gripping means attached to said frame to apply gripping force to grip said engaging drum during rotation of said undivided continuous axle; as said undivided continuous axle rotates in a forward direction, said engaging drum being shifted to move by said differential matching screw in one direction, as said engaging drum engages with said hub body, said wheel being driven to rotate in forward direction; as said undivided continuous axle rotates in reverse direction, said engaging drum being shifted by said differential matching screw to move in another direction, as said engaging drum engages with said hub body, said wheel being driven to rotate in reverse direction;

said undivided continuous axle differential transmission drive having transmission functions of running forward, running backward, free-running and differential function that wheels have different rotating speeds; said wheels having different rotating speed being in differential drive mode: as said undivided continuous axle rotates slower than said wheels, said wheels are disengaged and free-running; when said wheels have different rotating speeds, said undivided continuous axle driving said wheel having slower rotating speed; said engaging drum engaging with said hub to drive said wheel having slower rotating speed; said undivided continuous axle releasing said wheel having faster rotating speed; said engaging drum to be shifted backward to disengage with said hub to allow said wheel having faster rotating speed being free to run;

said undivided continuous axle differential transmission drive having anti-ice-skidding capability, as a vehicle spinning on ice, wheels on outside curve rotating faster than wheels at spinning center, said undivided continuous axle differential transmission drive releasing faster wheels and transmitting power to slower wheels to counter-balance of spinning momentum to pull out said vehicle from spinning and regain control of said vehicle;

said undivided continuous axle differential transmission drive having anti-sand-trapping capability, as said vehicle being trapped in sand, wheels having less frictional pulling force rotating faster than wheels having larger frictional pulling force, said undivided continuous axle differential transmission drive releasing faster wheels and transmitting power to slower wheels to gain more pulling force to pull out said vehicle from sand trap;

said undivided continuous axle having a crank portion, a floating link connecting said sliding link with said crank portion;

a pedal means being mounted at the top of said sliding link, a spring means biasing against said pedal to restore said pedal means to top position; treading on said pedal, said sliding link driving said floating link to rotate said undivided continuous axle to drive said wheels;

said sliding link means being able to drive said undivided continuous axle to rotate forward, backward and hold still;

during running, holding said pedal still, said undivided continuous axle being held still and said wheels being released to be free-running;

during running, driving said undivided continuous axle to rotate in reverse direction, said wheels being braked to stop;

during running, as said pedal rotating 180 degrees, said wheel being braked to stop;

treading on said pedal and twisting said pedal, said undivided continuous axle differential transmission drive apparatus driving and turning direction simultaneously, said wheel on outside curve being released to rotate faster, a swiveling movement of said undivided continuous axle and friction on ground speeding said wheels on outside curve to spinning faster to have differential drive of said wheels.

10. A synchronous steering differential transmission drive apparatus according to claim 9 of which gripping means comprises a spring means biasing against said engaging drum to grip said engaging drum.

11. A synchronous steering differential transmission drive apparatus according to claim 9 of which gripping means comprises a spring means biasing against a plate having a protrude means to fit in a recess on the surface of said engaging drum to grip said engaging drum.

12. A synchronous steering differential transmission drive apparatus according to claim 9 of which gripping means comprises poles of noncontact force embedded in said frame and said engaging drum, said poles of noncontact force generating force to grip said engaging drum.

13. A synchronous steering differential transmission drive apparatus according to claim 9 of which said poles of noncontact force are magnetic poles.

14. A synchronous steering differential transmission drive apparatus according to claim 9 of which said engaging drum has wedge means to engaging with said hub portion.

15. A synchronous steering differential transmission drive apparatus according to claim 9 of which said engaging drum further comprises a plurality wedge means of ring segment to engage with said hub portion.

16. A synchronous steering differential transmission transportation facility comprising a plurality of synchronous steering differential transmission drive apparatus, said synchronous steering differential transmission drive apparatus comprises a frame means, a plurality of wheels being rotationally mounted on an undivided continuous axle with a plurality of differential drive means, said frame means has a pivot joint means at top to support an elongated board means, a sliding link means passing through a slot inside said pivot joint means, twisting said sliding link, said frame rotating to steer said wheel to turn in new direction;

said undivided continuous axle being rotationally mounted on said frame, said differential drive means being mounted at a hub of each said wheel, said undivided continuous axle being rotationally mounted on said wheels passing through said differential drive means; inside each of said differential drive means, a differential matching screw being notched on said undivided continuous axle;

said differential drive means comprising a hub body, an engaging drum and a gripping means for said engaging drum; said hub body being rotationally mounted on said undivided continuous axle and said frame;

for each of said differential drive means, said engaging drum being rotationally mounted on said differential matching screw of said undivided continuous axle; as said engaging drum engages with said hub body, said wheel being driven to rotate by said undivided continuous axle; as said undivided continuous axle driving said wheels to rotate first, then said undivided continuous axle slowing don rotating speed, each of said differential matching screws on each end of the continuous axle having opposite screw directions such that all said wheels are released to be free running;

said gripping means attached to said frame to apply gripping force to grip said engaging drum during rotation of said undivided continuous axle; as said undivided continuous axle rotates in a forward direction, said engaging drum being shifted to move by said differential matching screw in one direction, as said engaging drum engages with said hub body, said wheel being driven to rotate in forward direction; as said undivided continuous axle rotates in reverse direction, said engaging drum being shifted by said differential matching screw to move in another direction, as said engaging drum engages with said hub body, said wheel being driven to rotate in reverse direction;

said undivided continuous axle differential transmission drive having transmission functions of running forward, running backward, free-running and differential function that wheels have different rotating speeds; said wheels having different rotating speed being in differential drive mode: as said undivided continuous axle rotates slower than said wheels, said wheels are disengaged and free-running; when said wheels have different rotating speeds, said undivided continuous axle driving said wheel having slower rotating speed; said engaging drum engaging with said hub to drive said wheel having slower rotating speed; said undivided continuous axle releasing said wheel having faster rotating speed; said engaging drum to be shifted backward to disengage with said hub to allow said wheel having faster rotating speed being free to run;

said undivided continuous axle differential transmission drive having anti-ice-skidding capability, as a vehicle spinning on ice, wheels on outside curve rotating faster than wheels at spinning center, said undivided continuous axle differential transmission drive releasing faster wheels and transmitting power to slower wheels to counter-balance of spinning momentum to pull out said vehicle from spinning and regain control of said vehicle;

said undivided continuous axle differential transmission drive having anti-sand-trapping capability, as said vehicle being trapped in sand, wheels having less frictional pulling force rotating faster than wheels having larger frictional pulling force, said undivided continuous axle differential transmission drive releasing faster wheels and transmitting power to slower wheels to gain more pulling force to pull out said vehicle from sand trap;

said undivided continuous axle having a crank portion, a floating link connecting said sliding link with said crank portion;

a pedal means being mounted at the top of said sliding link, a spring means biasing against said pedal to restore said pedal means to top position; treading on said pedal, said sliding link driving said floating link to rotate said undivided continuous axle to drive said wheels;

said sliding link means being able to drive said undivided continuous axle to rotate forward, backward and hold still;

during running, holding said pedal still, said undivided continuous axle being held still and said wheels being released to having free-running;

during running, driving said undivided continuous axle to rotate in reverse direction, said wheels being braked to stop;

during running, as said pedal rotating 180 degrees, said wheel being braked to stop;

treading on said pedal and twisting said pedal, said undivided continuous axle differential transmission drive apparatus driving and turning direction simultaneously, said wheel on outside curve being released to rotate faster, a swiveling movement of said undivided continuous axle and friction on ground speeding said wheels on outside curve to spinning faster to have differential drive of said wheels.

17. A synchronous steering differential transmission transportation facility according to claim 16 further comprising fast release slipper means, said slipper means being installed on said pedal means and board means.

18. A synchronous steering differential transmission transportation facility comprising a plurality of synchronous steering differential transmission drive apparatus and belt means, said synchronous steering differential transmission drive apparatus comprises a frame means, a plurality of wheels being rotationally mounted on an undivided continuous axle with a plurality of differential drive means, said frame means has a pivot joint means at top to support an elongated board means, a sliding link means passing through a slot inside said pivot joint means, twisting said sliding link, said frame rotating to steer said wheel to turn in new direction;

said undivided continuous axle being rotationally mounted on said frame, said differential drive means being mounted at a hub of each said wheel, said undivided continuous axle being rotationally mounted on said wheels passing through said differential drive means; inside each of said differential drive means, a differential matching screw being notched on said undivided continuous axle;

said differential drive means comprising a hub body, an engaging drum and a gripping means for said engaging drum; said hub body being rotationally mounted on said undivided continuous axle and said frame;

for each of said differential drive means, said engaging drum being rotationally mounted on said differential matching screw of said undivided continuous axle; as said engaging drum engages with said hub body, said wheel being driven to rotate by said undivided continuous axle; as said undivided continuous axle driving said wheels to rotate first, then said undivided continuous axle slowing down rotating speed, each of said differential matching screws on each end of the continuous axle having opposite screw directions such that all said wheels are released to be free running;

said gripping means attached to said frame to apply gripping force to grip said engaging drum during rotation of said undivided continuous axle; as said undivided continuous axle rotates in a forward direction, said engaging drum being shifted to move by said differential matching screw in one direction, as said engaging drum engages with said hub body, said wheel being driven to rotate in forward direction; as said undivided continuous axle rotates in reverse direction, said engaging drum being shifted by said differential matching screw to move in another direction, as said engaging drum engages with said hub body, said wheel being driven to rotate in reverse direction;

said undivided continuous axle differential transmission drive having transmission functions of running forward, running backward, free-running and differential function that wheels have different rotating speeds; said wheels having different rotating speed being in differential drive mode: as said undivided continuous axle rotates slower than said wheels, said wheels are disengaged and free-running; when said wheels have different rotating speeds, said undivided continuous axle driving said wheel having slower rotating speed; said engaging drum engaging with said hub to drive said wheel having slower rotating speed; said undivided continuous axle releasing said wheel having faster rotating speed; said engaging drum to be shifted backward to disengage with said hub to allow said wheel having faster rotating speed being free to run;

said undivided continuous axle differential transmission drive having anti-ice-skidding capability, as a vehicle spinning on ice, wheels on outside curve rotating faster than wheels at spinning center, said undivided continuous axle differential transmission drive releasing faster wheels and transmitting power to slower wheels to counter-balance of spinning momentum to pull out said vehicle from spinning and regain control of said vehicle;

said undivided continuous axle differential transmission drive having anti-sand-trapping capability, as said vehicle being trapped in sand, wheels having less frictional pulling force rotating faster than wheels having larger frictional pulling force, said undivided continuous axle differential transmission drive releasing faster wheels and transmitting power to slower wheels to gain more pulling force to pull out said vehicle from sand trap;

said undivided continuous axle having a crank portion, a floating link connecting said sliding link with said crank portion;

a pedal means being mounted at the top of said sliding link, a spring means biasing against said pedal to restore said pedal means to top position; treading on said pedal, said sliding link driving said floating link to rotate said undivided continuous axle to drive said wheels;

said sliding link means being able to drive said undivided continuous axle to rotate forward, backward and hold still;

during running, holding said pedal still, said undivided continuous axle being held still and said wheels being released to having free-running, during running, driving said undivided continuous axle to rotate in reverse direction, said wheels being braked to stop;

treading on said pedal and twisting said pedal, said undivided continuous axle differential transmission drive apparatus driving and turning direction simultaneously, said wheel on outside curve being released to rotate faster, a swiveling movement of said undivided continuous axle and friction on ground speeding said wheels on outside curve to spinning faster to have differential drive of said wheels;

said belt means comprises a flexible belt enwrapping and connecting the front wheels with the rear wheels, a dangling gear being mounted beneath said board means and connecting to a universal joint means with a pressing link, said gear pressing on said flexible belt to adjust a length of said belt means, a spring means being mounted on said pressing link to press said belt means with a wedge angle, as said wheel pulls said belt means, said wedge angle become larger to push said belt means harder to make said belt means have larger tension to support weight.

19. A synchronous steering differential transmission transportation facility according to claim 18 wherein said belt means comprises a plurality of pad means enwrapping a string.

20. A synchronous steering differential transmission transportation facility according to claim 18 wherein said pad has protrude means and notch means to increase friction.

* * * * *